US006057869A

United States Patent [19]

Kawaishi et al.

[11] Patent Number: 6,057,869

[45] Date of Patent: May 2, 2000

[54] IMAGE FORMING APPARATUS FOR FIXING A TONER IMAGE AT A FIRST SPEED OR AT A SECOND SPEED

[75] Inventors: Yasunori Kawaishi, Narashino; Kenichi Mizuma; Hideya Furuta, both of Yokohama; Yoshihiro Sakai, Tokyo; Leo Munakata; Hideki Kamiyama, both of Yokohama; Minoru Sugiyama, Nishinomiya, all of Japan

[73] Assignee: Ricoh Company, Ltd., Tokyo, Japan

[21] Appl. No.: 08/912,811

[22] Filed: Aug. 19, 1997

Related U.S. Application Data

[63] Continuation of application No. 08/266,386, Jun. 27, 1994, abandoned.

[30] Foreign Application Priority Data

Jun. 28, 1993 [JP] Japan ..... 5-182051

[51] Int. Cl.[7] ..... B41J 2/385; G03G 9/08; G03G 15/20

[52] U.S. Cl. ..... 347/153; 399/68

[58] Field of Search ..... 347/154, 153; 430/48, 199; 399/154, 302, 308, 45, 66, 301, 322, 68

[56] References Cited

U.S. PATENT DOCUMENTS

| | | | |
|---|---|---|---|
| 4,451,136 | 5/1984 | Tanioka et al. | 355/210 |
| 4,519,700 | 5/1985 | Barker et al. | 355/271 |
| 5,041,878 | 8/1991 | Takai et al. . | |
| 5,138,392 | 8/1992 | Kinoshita et al. . | |
| 5,160,970 | 11/1992 | Isogai . | |
| 5,216,453 | 6/1993 | Itoh | 347/154 |
| 5,260,751 | 11/1993 | Inomata . | |

FOREIGN PATENT DOCUMENTS

| | | |
|---|---|---|
| 41 13 560 | 10/1991 | Germany . |
| 4 228365 | 3/1993 | Germany . |

*Primary Examiner*—John Barlow
*Assistant Examiner*—Raquel Yvette Gordon
*Attorney, Agent, or Firm*—Oblon, Spivak, McClelland, Maier & Neustadt, P.C.

[57] ABSTRACT

An image forming apparatus of the type forming a toner image on a photoconductive drum or similar image carrier, transferring it to a paper or similar transfer medium via an intermediate transfer body, e.g., belt, and fixing it on the medium by a fixing device is disclosed. Just after the transfer of a toner image of the last color which is to lie over the other toner images on the intermediate transfer belt, the peripheral speed of the belt is switched to a comparatively low speed matching a fixing and paper transport speed. At this instant, the belt is moved away from the drum. The length of the transfer medium and the distance between a paper transfer position and a fixing position is compared. For a relatively short transfer medium, the peripheral speed of the belt is not switched to the low speed.

10 Claims, 22 Drawing Sheets

| Fig. 5A | Fig. 5B | Fig. 5C |
|---|---|---|

| Fig. 6A | Fig. 6B | Fig. 6C |
|---|---|---|

| |
|---|
| Fig. 7A |
| Fig. 7B |
| Fig. 7C |

A
D'
REFERENCE TRANSFER SIGNAL ARRIVED ?
NO
YES
START ROTATING BELT
BELT CONTACT ON
BELT MOVED PREDETERMINED DISTANCE ?
NO
YES
BELT CONTACT OFF
STOP DRIVING BELT

IMAGE FORMING APPARATUS FOR FIXING A TONER IMAGE AT A FIRST SPEED OR AT A SECOND SPEED

This is a continuation of application Ser. No. 08/266,386, filed on Jun. 27, 1994, now abandoned.

BACKGROUND OF THE INVENTION

The present invention relates to a copier, facsimile apparatus, printer or similar image forming apparatus and, more particularly, to an image forming apparatus of the type forming a toner image on a photoconductive drum or similar image carrier, transferring it to a paper or similar transfer medium via an intermediate transfer body, e.g., belt, and fixing it on the medium by a fixing device.

Image forming apparatuses of the type described include a color image forming apparatus which sequentially forms toner images of different colors on an image carrier, sequentially transfers them to an intermediate transfer body one above the other, and transfers the resulting multicolor image from the transfer body to a transfer medium at a time. Also known in the art is an image forming apparatus which transfers a toner image from an image carrier to a transfer medium and fixes it on the medium by a fixing device. This kind of apparatus may be provided with a switching means for switching the speed at which the transfer medium moves through the fixing device, depending on the kind of the medium, e.g., whether or not the medium is a relatively thick paper, e.g., OHP (Over Head Projector) sheet which needs a substantial fixing time. Usually, such switching means is actuated by a signal from a mode switch which is operated by an operator.

Assume that the apparatus of the kind using an intermediate transfer body is constructed to switch even the peripheral speeds of the image carrier and intermediate transfer body when it sets up a lower fixing speed. This brings about a problem that process conditions for the formation of a toner image become complicated and/or the image forming speed is noticeably lowered. For example, in an electrophotographic image forming apparatus, it is necessary to change the charging condition, exposing condition and other process conditions. As a result, not only optimal process conditions each matching a particular peripheral speed have to be determined at great cost, but also complicated control is necessary over the process conditions of the apparatus. In addition, the image forming speed is critically lowered since all the steps, i.e., the toner image forming step to the fixing step are effected at low speed.

SUMMARY OF THE INVENTION

It is, therefore, an object of the present invention to provide an image forming apparatus capable of switching a fixing speed without switching the peripheral speed of an image carrier necessary for toner image formation.

In accordance with the present invention, in an image forming apparatus for forming a toner image on an image carrier, transferring it to an intermediate transfer body, transferring it from the intermediate transfer body to a transfer medium by a transferring device, and fixing it on the transfer medium by a fixing device, a fixing speed switching device selectively causes the transfer medium to move through the fixing means at a first speed matching a peripheral speed of the image carrier necessary for toner image formation or at a second speed lower than the first speed. A peripheral speed switching device switches, when the fixing speed switching device sets up the second speed, the peripheral speed of the intermediate transfer body, which has been maintained at a peripheral speed matching the peripheral speed of the image carrier necessary for toner image formation at least during the transfer of the toner image from the intermediate transfer body, to a peripheral speed matching the second speed.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
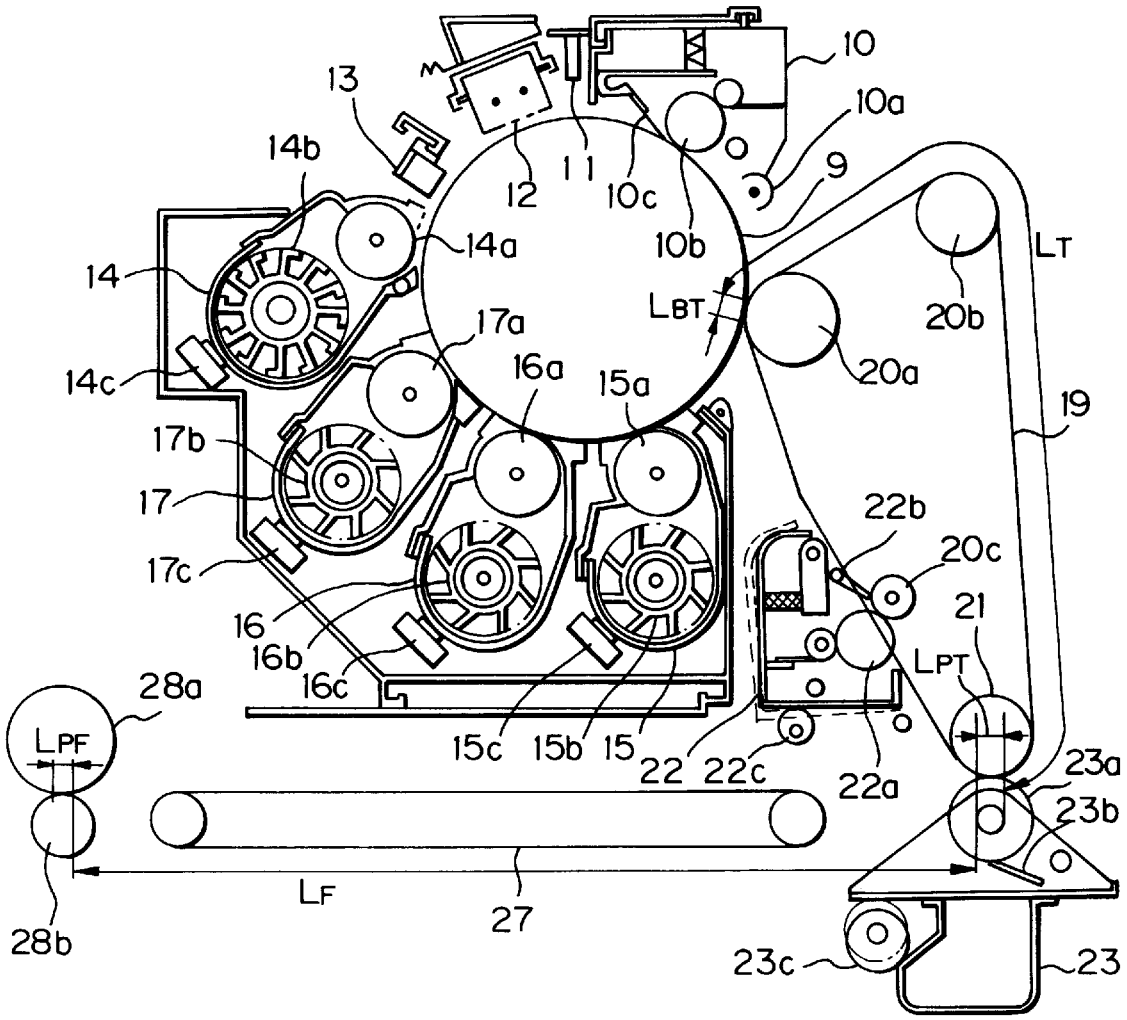
FIG. 1 is a section showing a photoconductive element and an intermediate transfer belt included in a color copier embodying the present invention, together with various units arranged therearound.
Figure 2B:
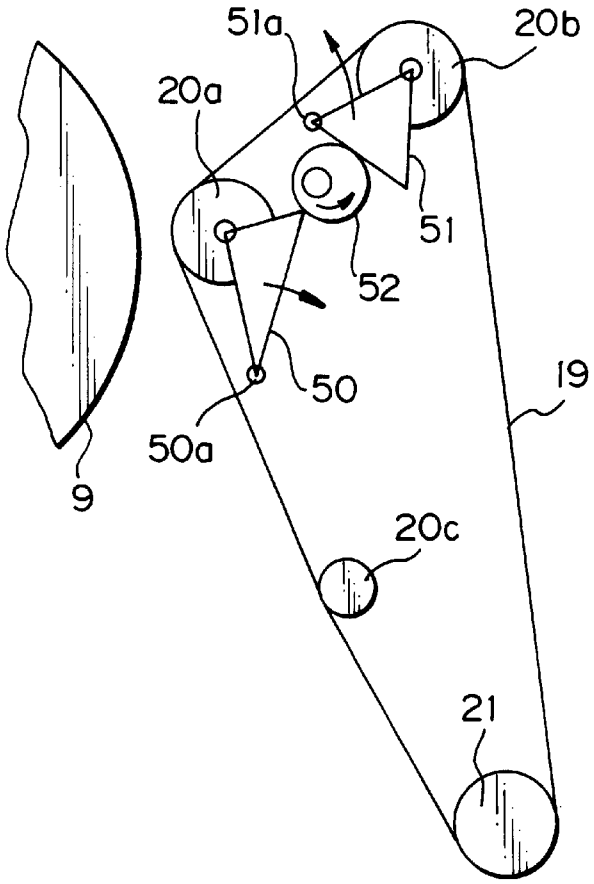
FIGS. 2A and 2B demonstrate the operation of a mechanism supporting the intermediate transfer belt.
Figure 2A:
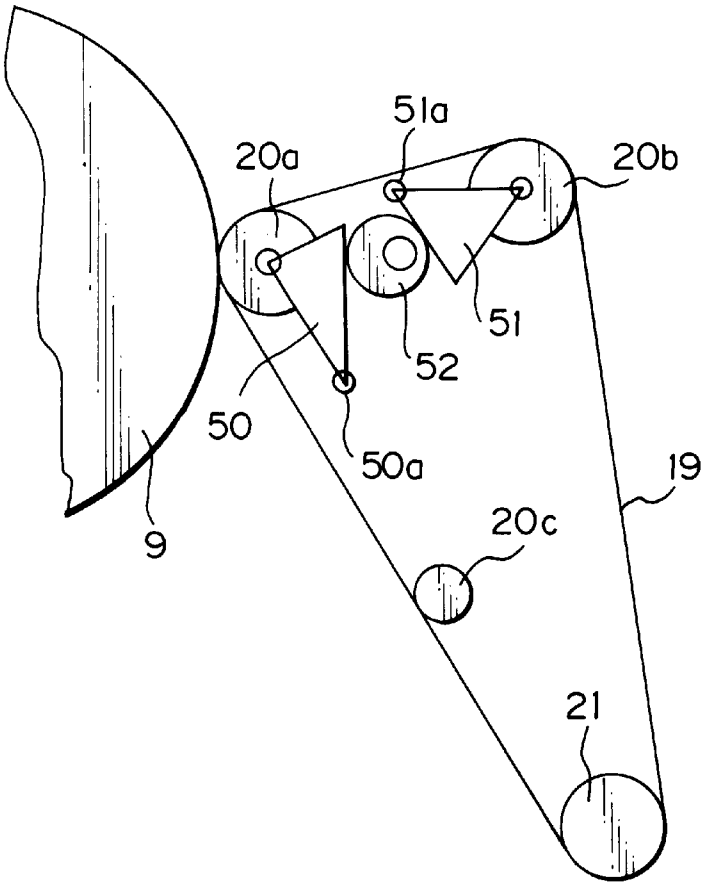
Figure 3:
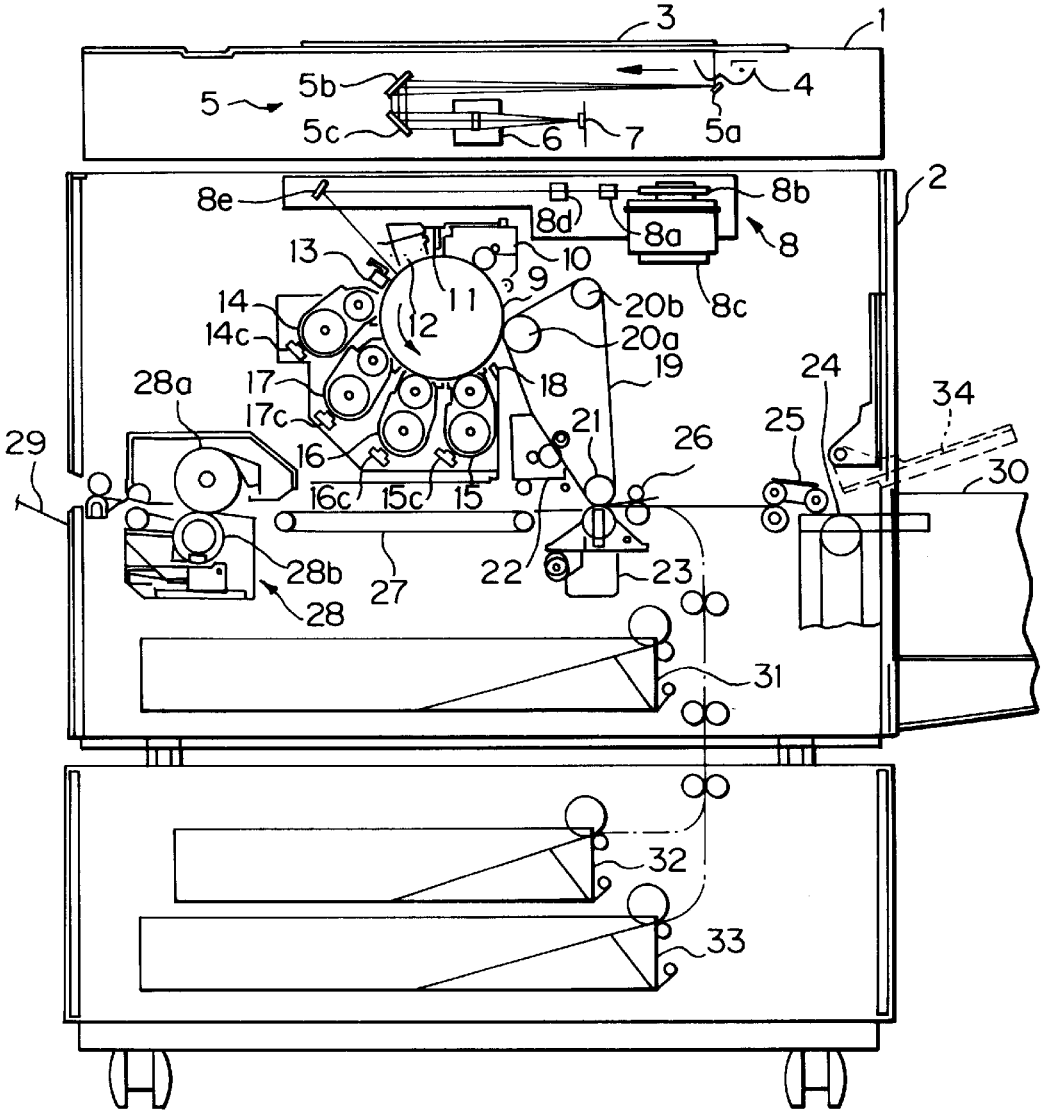
FIG. 3 is a section showing the general construction of the embodiment.

Referring to FIGS. 1, 2 and 3, an image forming apparatus embodying the present invention is shown and implemented as a color copier by way of example. To begin with, the general construction of the color copier will be described with reference to FIG. 3. As shown, the color copier is generally made up of a color image reading device, or color scanner, 1 and a color image recording device or color printer 2.

The color scanner 1 has a lamp 4 for illuminating a document 3. The resulting reflection from the document 3 is routed through mirrors 5, i.e., mirrors 5*a*–5*c*, and a lens 6 to a color sensor 7. As a result, the color image data of the document 3 are read on a separated color component basis, e.g., as a blue (B), green (G) and red (R) components. These color components B, G and R are each converted to an electric image signal. An image processor, not shown, executes color conversion based on the intensity levels of the image signals B, G and R generated by the color scanner 1, thereby producing black (Bk), cyan (C), magenta (M) and yellow (Y) color image data.

The color printer 2 has an optical writing unit 8. On receiving any one of the color image data Bk, C, M and Y from the color scanner 1, the writing unit 8 converts it to an optical signal and then electrostatically forms a latent image representative of the document on a photoconductive element, or image carrier, 9. In the illustrative embodiment, the photoconductive element 9 is implemented as a drum and rotatable counterclockwise, as indicated by an arrow in FIG. 3. Arranged around the drum 9 are a drum cleaning unit (including a precleaning discharger) 10, a discharge lamp 11, a main charger 12, a potential sensor 13, a Bk developing unit 14, a C developing unit 15, an M developing unit 16, a Y developing unit 17, a photosensor 18 responsive to a predetermined density pattern for development, an intermediate transfer belt 19, etc. As shown in FIG. 1, the developing units 14–17 each includes a developing sleeve (14*a,* 15*a,* 15*a,* 17*a*), a paddle (14*b,* 15*b,* 16*b,* 17*b*), and a toner concentration sensor (14*c,* 15*c,* 16*c,* 17*c*). The developing sleeve is rotatable with a developer deposited thereon contacting the surface of the drum 9, thereby developing the above-mentioned latent image. The paddle is rotated to scoop up and agitate the developer.

The operation of the color copier will be outlined on the assumption that a Bk toner image, C toner image, M toner image and Y toner image are sequentially formed in this order by way of example. On the start of a copying operation, the color scanner 1 starts reading Bk image data at a predetermining time, and the color printer 2 starts forming a latent image with a laser beam on the basis of the image data. Let the latent image associated with the Bk image data be referred to as a Bk latent image for simplicity. This is also true with latent images associated with C, M and Y image data. Before the leading edge of the Bk latent image arrives at a developing position assigned to the Bk developing unit 14, the developing sleeve 14*a* starts rotating in order to develop the latent image from the leading edge. The sleeve 14*a* develops the Bk latent image with a Bk toner. As soon as the trailing edge of the Bk latent image moves away from the Bk developing position, the Bk developing unit 14 is deactivated. This is done at least before the leading edge of a C latent image based on C image data arrives at the Bk developing position.

The Bk toner image formed on the drum 9 is transferred to the surface of the intermediate transfer belt 19 which is moving at the same speed as the drum 9. The image transfer from the drum 9 to the belt 19 will be referred to as belt transfer hereinafter. The belt transfer is effected with the drum 9 and belt 19 contacting each other and with a predetermined bias voltage being applied to a transfer bias roller 20*a*. It is to be noted that the Bk, C, M and Y toner images sequentially formed on the drum 9 are transferred to the belt 19 in register with each other, and the resulting multicolor image is transferred from the belt 19 to a paper or similar transfer medium at a time. The image transfer from the belt 19 to a transfer medium will be referred to as paper transfer, as distinguished from belt transfer. An intermediate belt unit, including the belt 19, will be described specifically later.

After the Bk imaging step, a C imaging step begins on the drum 9. In this step, the color scanner 1 starts reading C image data with the result that a C latent image is formed on the drum 9 by a laser beam. Specifically, after the trailing edge of the Bk latent image has moved away from a developing position assigned to the C developing unit 15 and before the leading edge of the C latent image arrives thereat, the developing sleeve 15*a* starts rotating and develops the C latent image with a C toner. As soon as the trailing edge of the C latent image moves away from the C developing position, the C developing unit 15 is deactivated. This is also done before the leading edge of an M latent image reaches the C developing position. The C imaging step is followed by an M and a Y imaging step which will be understood by analogy.

An intermediate transfer belt unit will be described with reference to FIG. 1. As shown, the intermediate transfer belt 19 is passed over a drive roller 21 and driven rollers 20*b* and 20*c* as well as over the previously mentioned bias roller 20*a*. A drive motor, not shown, causes the belt 19 to move as will be described later. FIGS. 2A and 2B show a specific mechanism for moving the belt 19 into and out of contact with the drum 9. As shown, the mechanism includes a support member 50 supporting the bias roller 20*a,* which faces the drum 9, in a rotatable manner. The support member 50 is pivotable about a fulcrum 50*a*. A support member 51 supports the driven roller 20*b,* which adjoins the bias roller 20*a,* in a rotatable manner and is pivotable about a fulcrum 51*a*. The reference numeral 52 designates a cam member. The support members 50 and 51 are each pressed against the cam member 52 by a biasing member. In this configuration, when the cam member 52 is rotated, the support members 50 and 51 move in the same direction toward or away from the drum 9 without changing the distance therebetween.

A belt cleaning unit 22 is located at a predetermined position where it faces the belt 19. The belt cleaning unit 22 includes a brush roller 22*a,* a rubber blade 22*b,* and a mechanism 22*c* for moving the unit 22 into and out of contact with the belt 19. During the belt transfer of the second, third and fourth toner images which follows the belt transfer of the first or Bk toner image, the mechanism 22*c* maintains the unit 22 spaced apart from the belt 19. Subsequently, the mechanism 22*c* brings the unit 22 into contact with the belt 19 at predetermining timing so as to clean the belt 19.

A paper transfer unit 23 is positioned to face part of the belt 19 which is wrapped around the drive roller 21. The paper transfer unit 23 includes a paper transfer roller 23*a,* a roller cleaning blade 23*b,* and a mechanism 23*c* for moving the unit 23 toward and away from the belt 19. Usually, the paper transfer roller 23*a* is spaced apart from the belt 19. At the time when the four-color or multicolor image should be transferred from the belt 19 to a paper or similar medium at a time, the mechanism 23*c* urges the roller 23*a* toward the belt 19. At the same time, a predetermined bias voltage is applied to the roller 23*a*. In this condition, the image is transferred from the belt 19 to the paper.

As shown in FIG. 3, the paper, designated by the reference numeral 24, is fed by a pick-up roller 25 and a registration roller 26 at such a time that the leading edge of the multicolor image on the belt 1 reaches a predetermined paper transfer position.

After the belt transfer of the first or Bk toner image, the belt 19 may be driven by any of three different methods which will be described hereinafter. Two or more of the methods to be described may be combined depending on the copy size, so long as they are desirable from the copy speed standpoint.

(I) Constant Speed Forward

Even after the belt transfer of a Bk toner image, the belt 19 is continuously moved forward at the same speed. A C toner image is formed on the drum 9 such that the leading edge thereof arrives at the belt transfer position, where the belt 19 contacts the drum 9, just when the leading edge of the Bk image on the belt 19 again arrives at the belt transfer position. As a result, the C image is transferred to the belt 19 over and in accurate register with the Bk image. This is repeated with an M and a Y toner image to complete a multicolor image on the belt 19. Thereafter, the belt 19 is continuously moved forward to transfer the multicolor image from the belt 19 to the paper 24 at a time, as stated previously.

(II) Skip Forward

After the belt transfer of a Bk toner image, the belt 19 is moved away from the drum 9 and then caused to skip forward at high speed. After the belt 19 has been moved a predetermined distance, it is caused to move forward at the original speed and again brought into contact with the drum 9. A C toner image is formed on the drum 9 such that the leading edge thereof arrives at the belt transfer position just when the leading edge of the Bk toner image again reaches the belt transfer position. Consequently, the C image is transferred to the belt 19 over and in accurate register with the Bk image. This is repeated with an M and a Y toner image to complete a multicolor image on the belt 19. Thereafter, the belt 19 is continuously moved forward at the same speed to transfer the multicolor image from the belt 19 to the paper 24 at a time.

(III) Reciprocation (Quick Return)

After the belt transfer of a Bk toner image, the belt 19 is moved away from the drum 9 and then caused to stop moving forward and, at the same time, returned at high speed. After the leading edge of the Bk image on the belt 19 has passed the belt transfer position backward and then moved a predetermined distance, the belt 19 is brought to a stop and caused to wait. Subsequently, the belt 19 is again moved forward when the leading edge of a C image formed on the drum 9 reaches a preselected position short of the belt transfer position. At the same time, the belt 19 is again brought into contact with the drum 9. Again, belt transfer is effected such that the C image lies on the Bk image on the belt 19 accurately. This is repeated with an M and a Y toner image to complete a multicolor image on the belt 19. After the belt transfer of the fourth or Y toner image, the belt 19 is continuously moved forward at the same speed without being returned. As a result, the multicolor image is transferred from the belt 19 to the paper 24 at a time.

As shown in FIG. 3, the paper 24 carrying the multicolor image thereon is conveyed to a fixing unit 28 by a paper transport unit 27. In the fixing unit 28, a heat roller 28*a*, controlled to a predetermined temperature, and a press roller 28*b* cooperate to fix the toner image on the paper 24 by heat and pressure. Subsequently, the paper, or full-color copy, is driven out of the copier to a copy tray 29.

After the belt transfer, the drum 9 has the surface thereof cleaned by the drum cleaning unit 10 (precleaning discharger 10*a*, brush roller 10*b* and rubber blade 10*c*) and then uniformly discharged by the discharge lamp 11. Also, after the transfer of the composite toner image from the belt 19 to the paper 24, the mechanism 22*c* again presses the cleaning unit 22 so as to clean the surface of the belt 19.

In a repeat copy mode, the second Bk (first color) imaging step is executed by the color scanner 1 and color printer 2 after the first Y (fourth color) imaging step. After the transfer of the first multicolor image from the belt 19 to the paper 24, the second Bk toner image is transferred from the drum 9 to the area of the belt 19 which has been cleaned by the cleaning unit 22.

Paper cassettes 30, 31, 32 and 33 are each loaded with papers of particular size. As any one of the cassettes 30–33 is selected on an operation panel, not shown, papers are sequentially fed out from the cassette toward the registration roller 26 at the previously mentioned timing. The reference numeral 34 designates a manual feed tray accessible for feeding OHP sheets or similar relatively thick papers.

While the foregoing description has concentrated on a four-color or full-color copy mode, a three- or two-color copy mode can be executed only if the procedure described above is repeated a number of times corresponding to the designated colors and the number of copies. In a single color copy mode, one of the developing units which stores a toner of desire color is maintained operative. At the same time, the belt 19 is moved forward at a constant speed in contact with the drum 9, while the belt cleaning unit 22 is held in contact with the belt 19.

Figure 4:
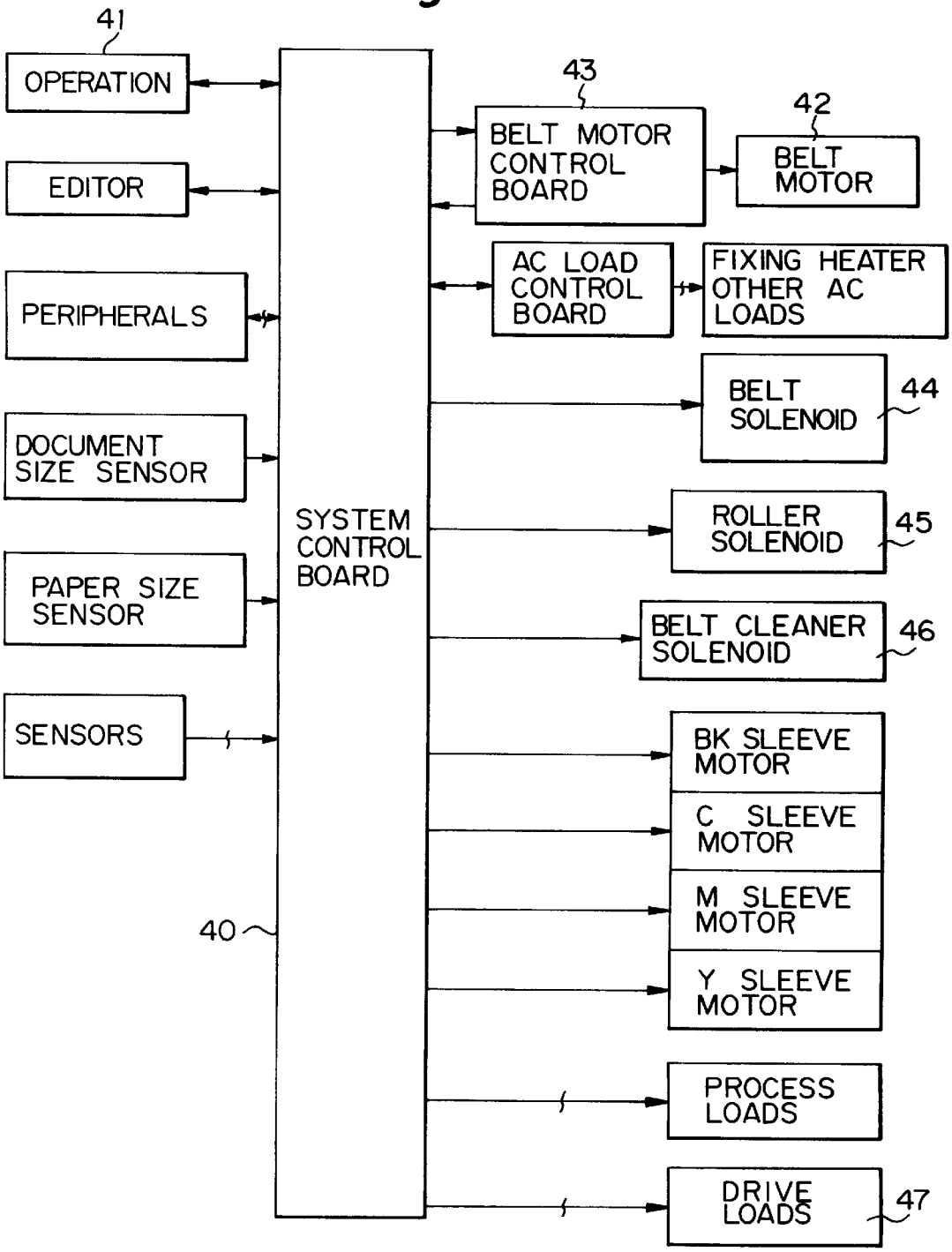
FIG. 4 is a block diagram schematically showing an electrical arrangement included in the embodiment.

Characteristic features and operations of the embodiment will be described which are implemented by the foregoing basic arrangement and procedures. The embodiment allows the operator to select one of two different modes, i.e., a plain paper mode for transferring toner images to plain papers, and an OHP mode for transferring them to OHP sheets or relatively thick papers. A paper is moved through the fixing unit 28 at a linear velocity of, for example, 180 mm/sec in the plain paper mode or at a linear velocity of, for example, 90 mm/sec in the OHP mode. In both of these alternative modes, the drum 9 is rotated at a constant peripheral speed of 180 mm/sec. As shown in FIG. 4, an operating section 41 is connected to a system control board 40 having a CPU (Central Processing Unit) and other elements provided thereon and therein. A mode button, not shown, is provided on the operating section 41 and accessible for selecting desired one of the two modes. The system control board 40 controls the entire color printer 2. A belt motor control board 43 is connected to the system control board 40 while a belt motor 42 for driving the drive roller 21 of the belt 19 is connected to the control board 43. Also connected to the system control board 40 are a belt solenoid 44 for driving the mechanism which moves the belt 19 into and out of contact with the drum 9, a roller solenoid 45 for driving the mechanism 23*c* which moves the paper transfer roller 23*a* toward and away from the drive roller 21, a belt cleaner solenoid 46 for driving the mechanism 22*c* for moving the belt cleaning unit 22, and various drive loads 47 and various process loads built in the color printer 2. The drive loads 47 include a motor for driving the rollers 28*a* and 28*b*, and a motor for driving the paper transport unit 27.

Figures 5, 5A:
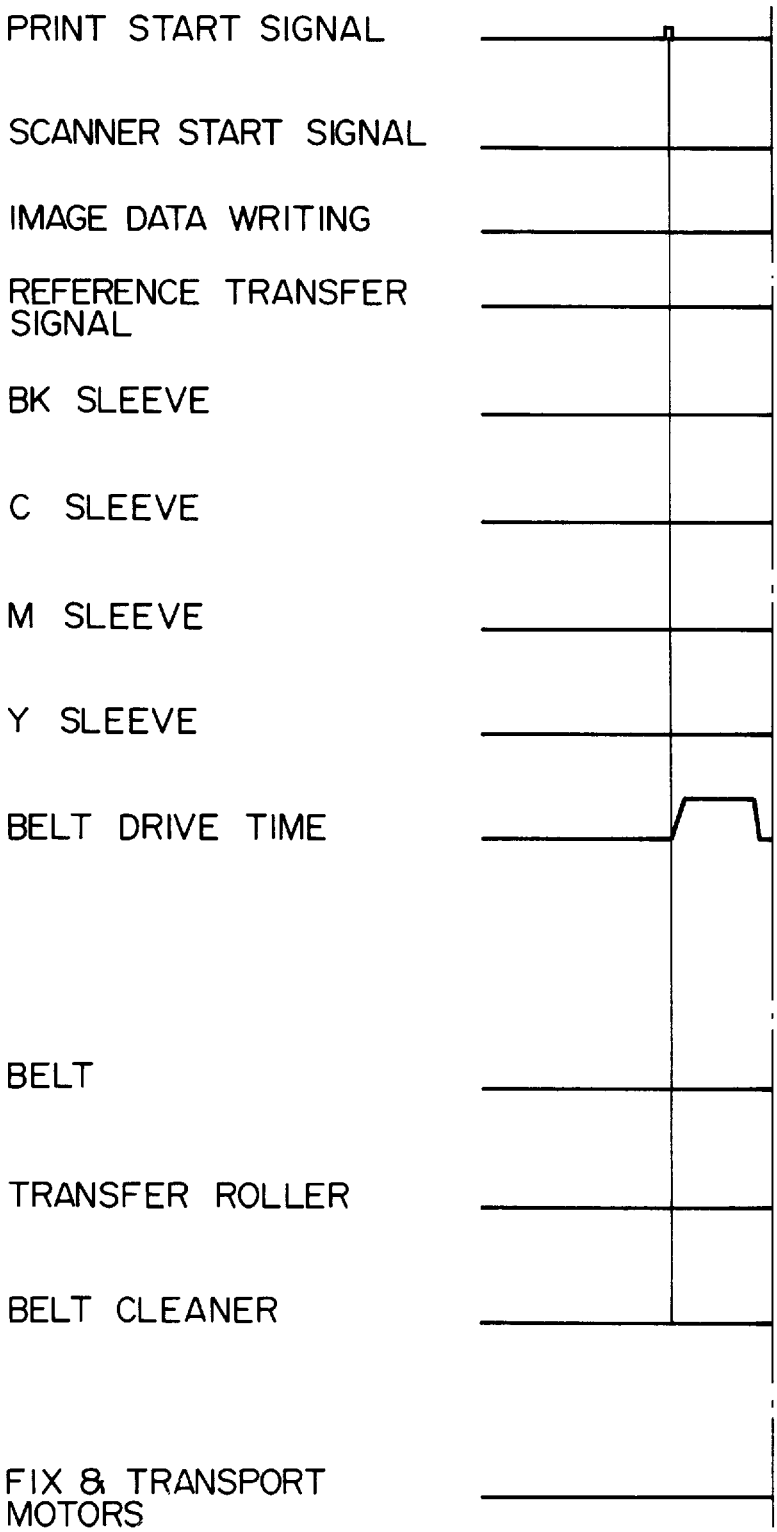
FIGS. 5 and 6 are timing charts respectively showing the operations of the embodiment to occur when a relation LP<LT holds and when a relation LP≧LT holds.
Figure 5B:
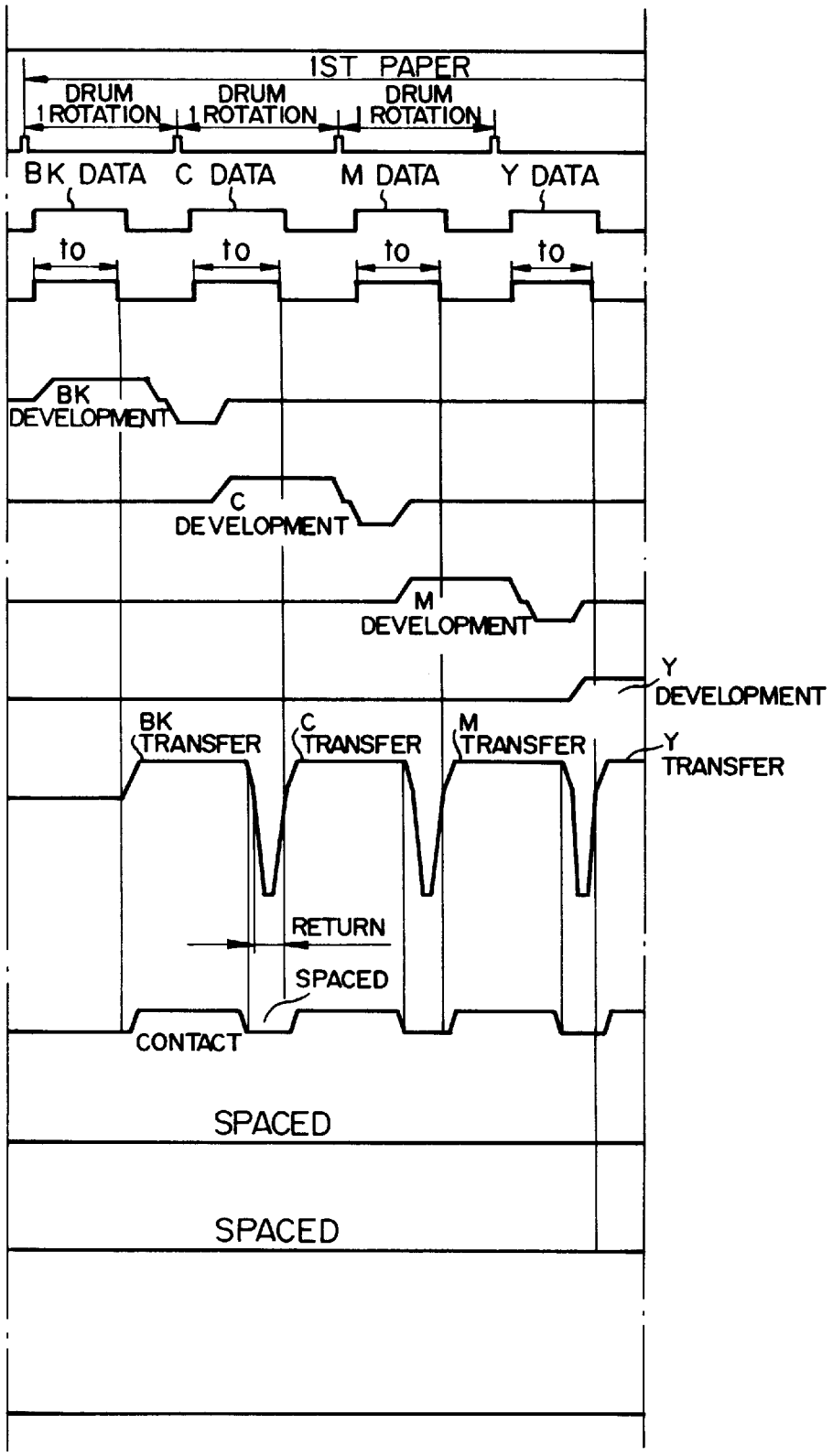
Figure 5C:
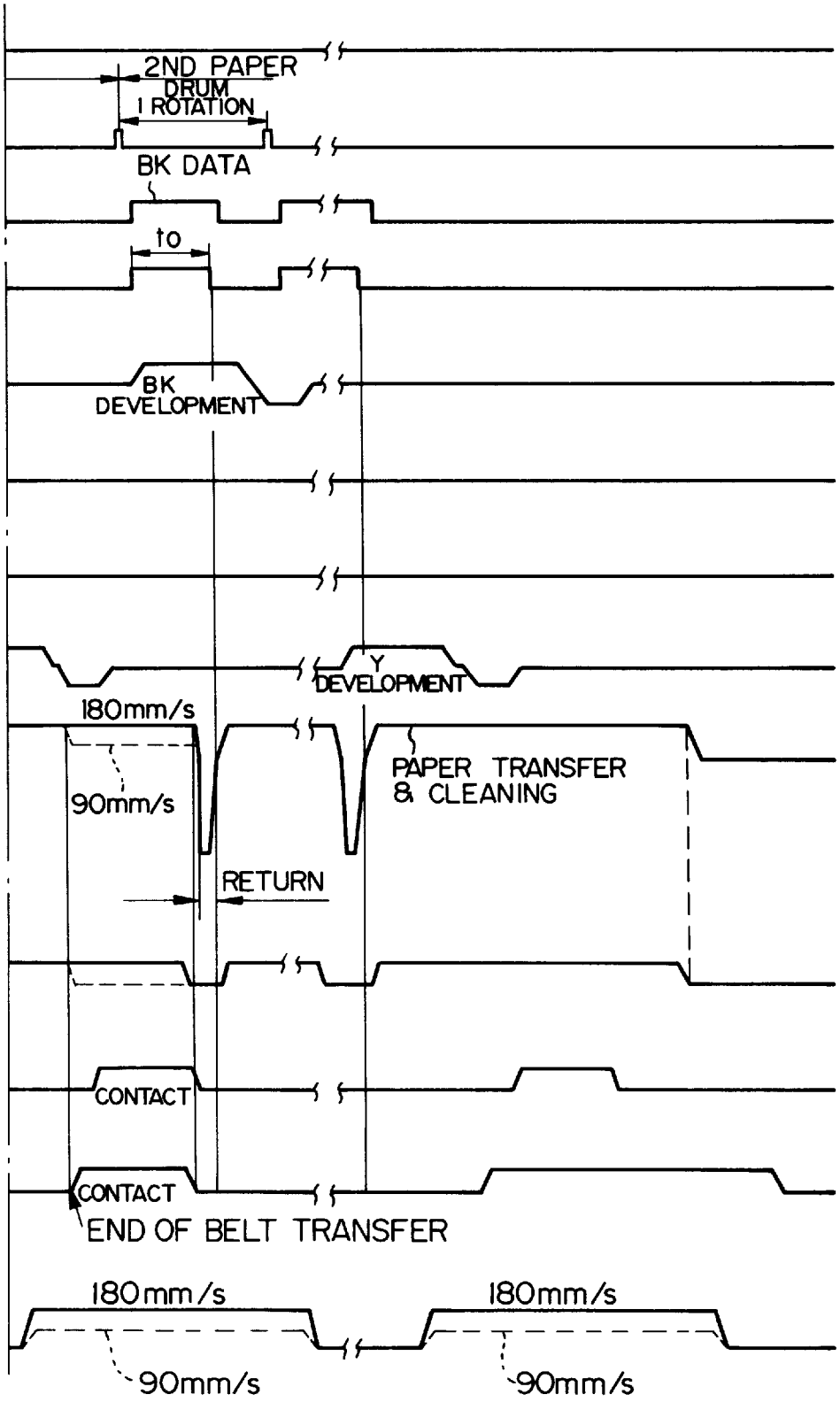
Figures 6, 6A:
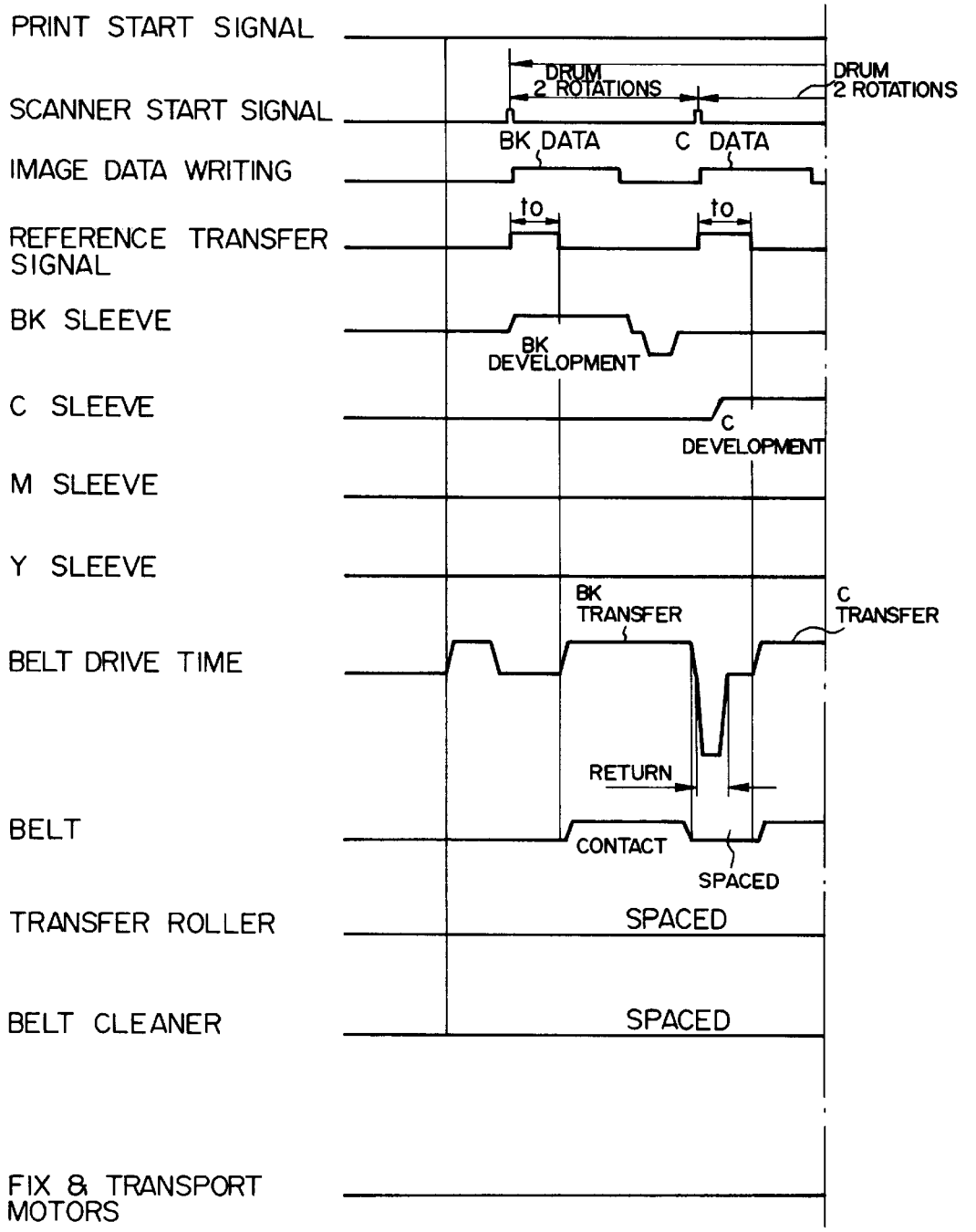
Figure 6B:
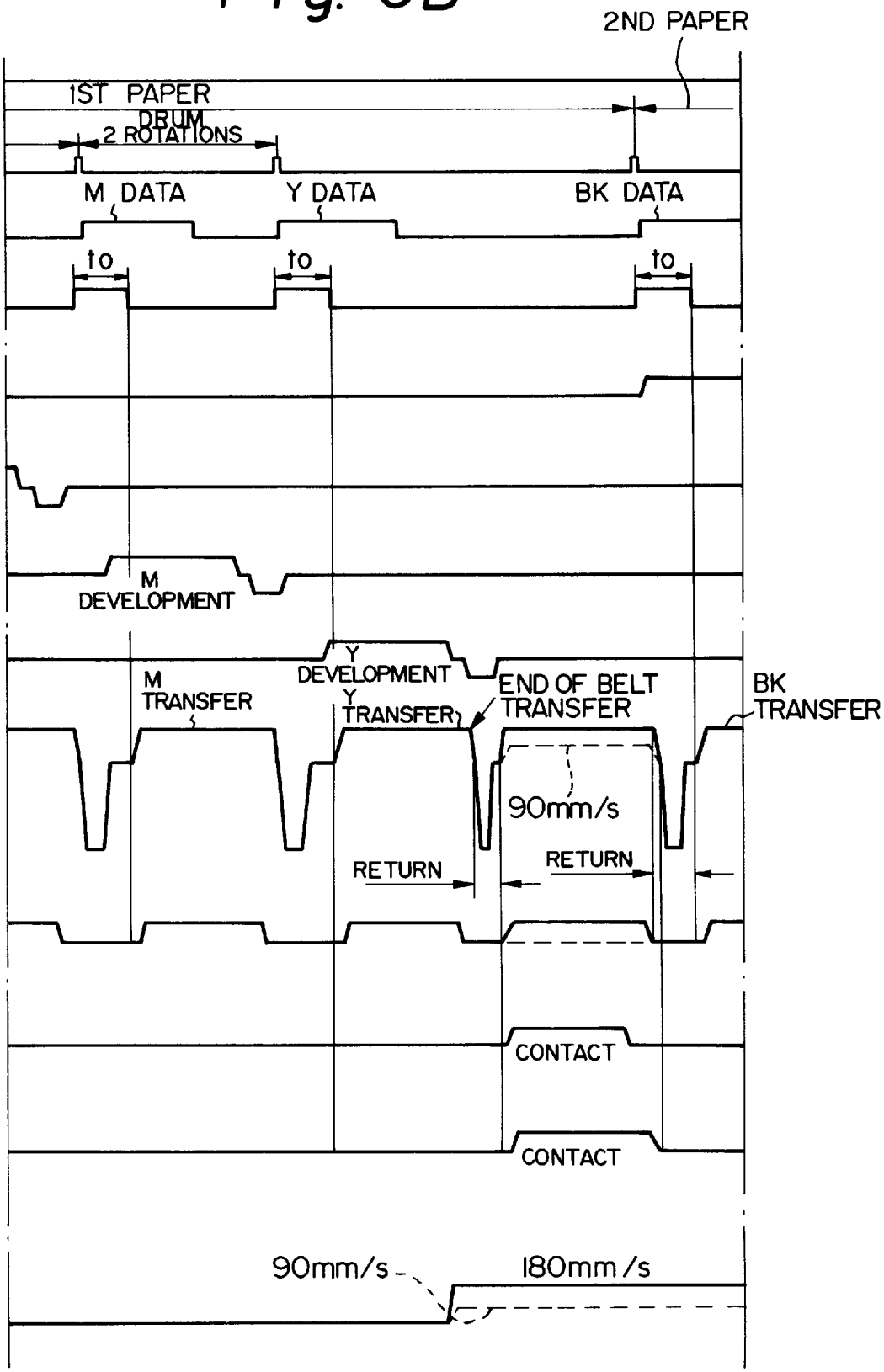
Figure 6C:
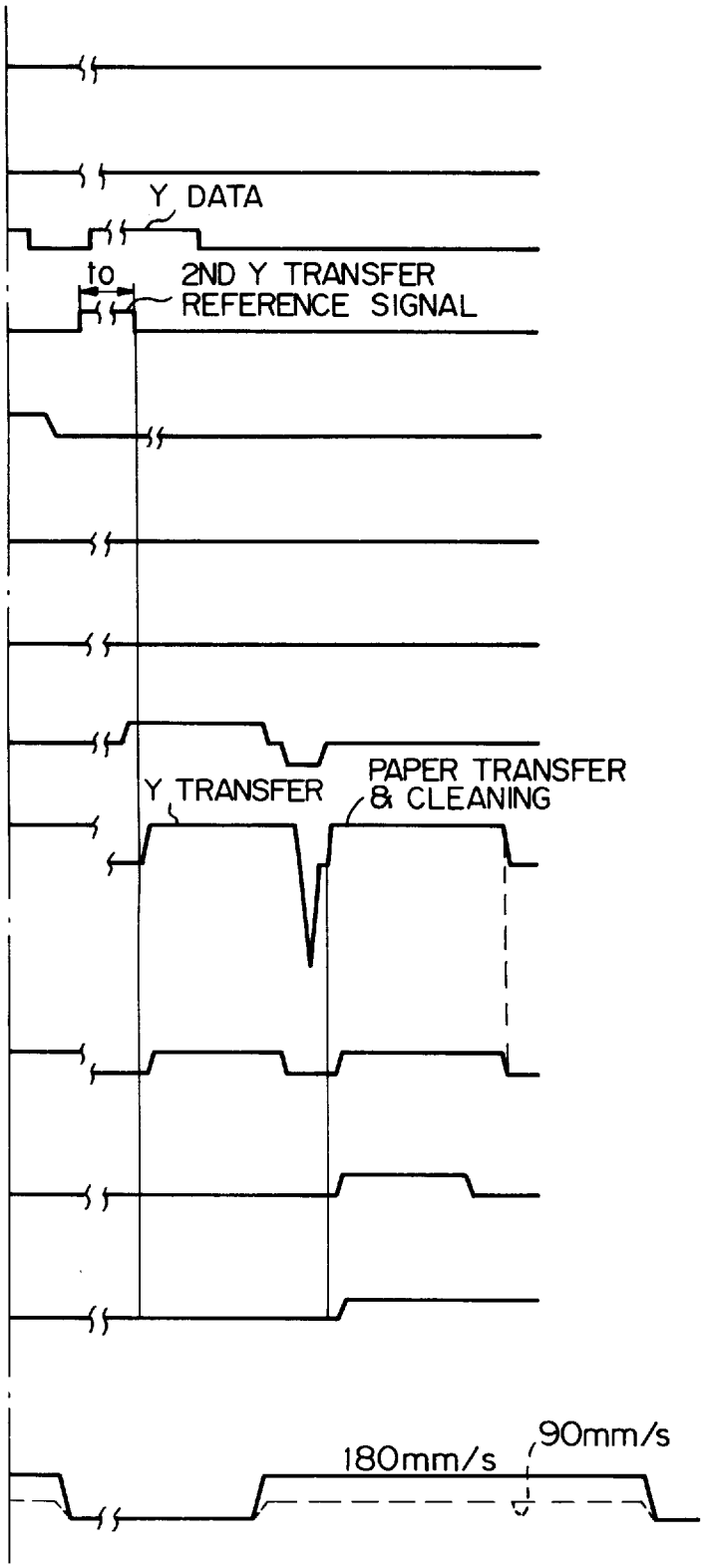
Figures 7, 7A:
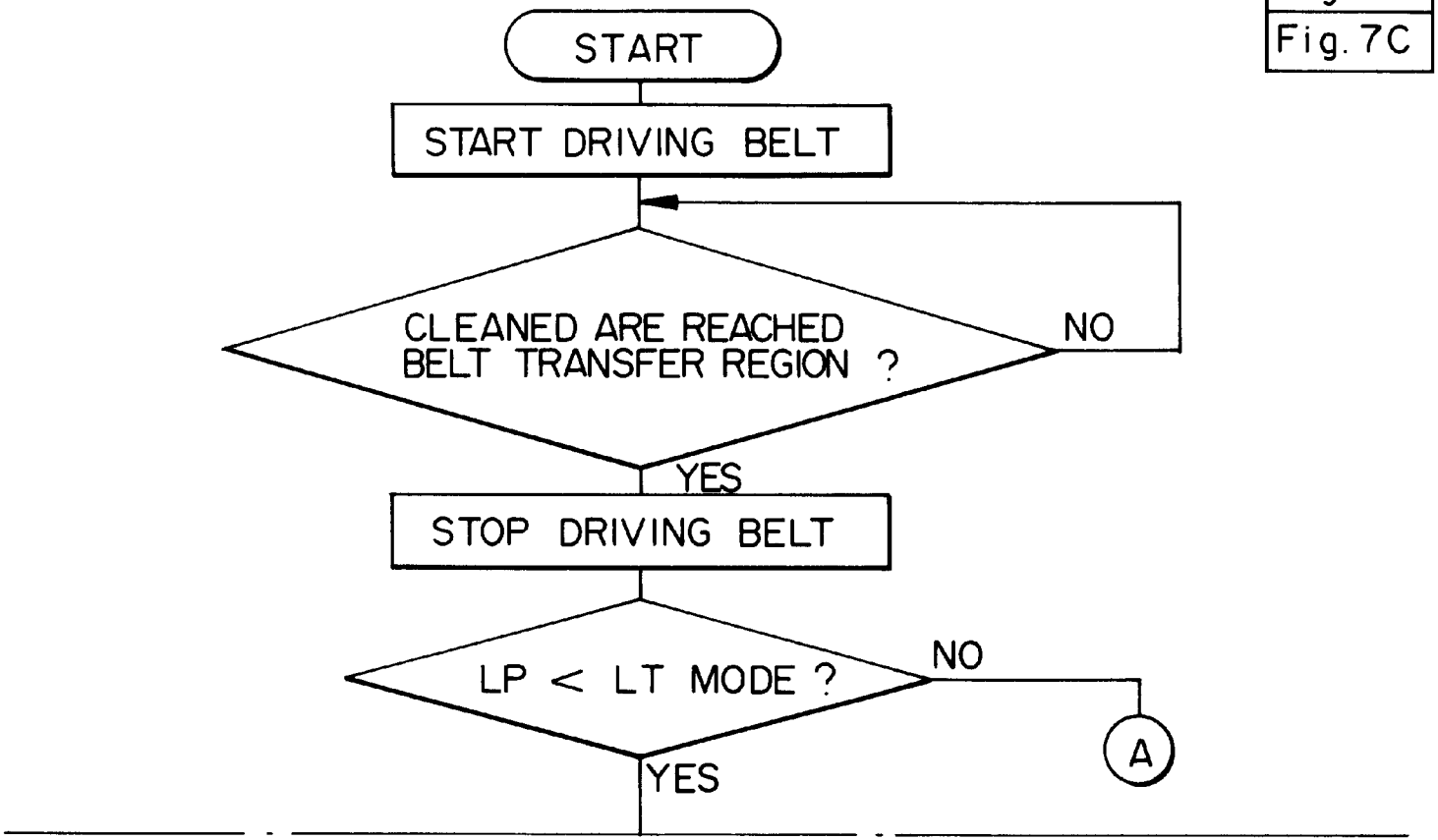
FIGS. 7 and 8 are flowcharts associated with FIGS. 5 and 6, respectively.
Figure 7B:
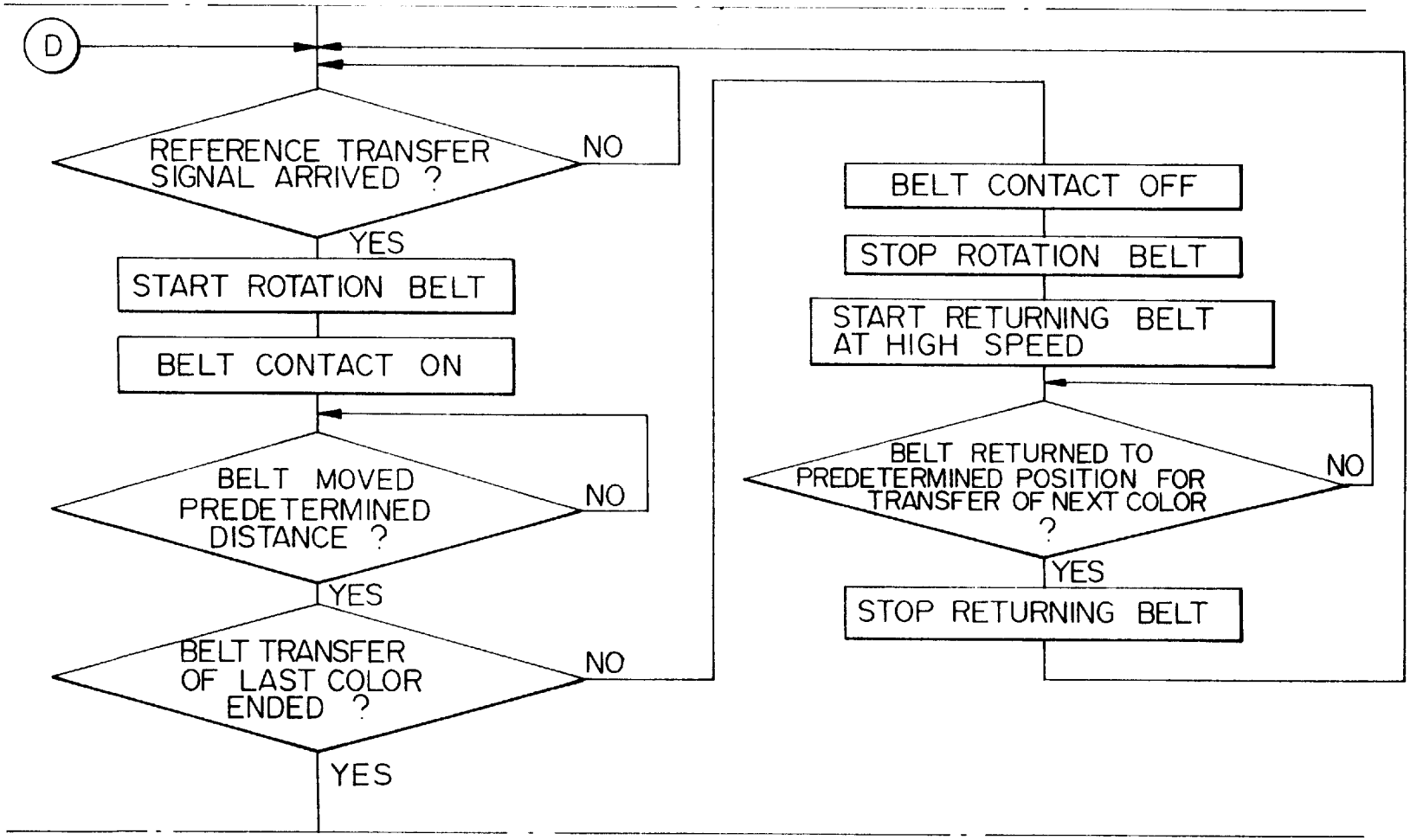
Figure 7C:
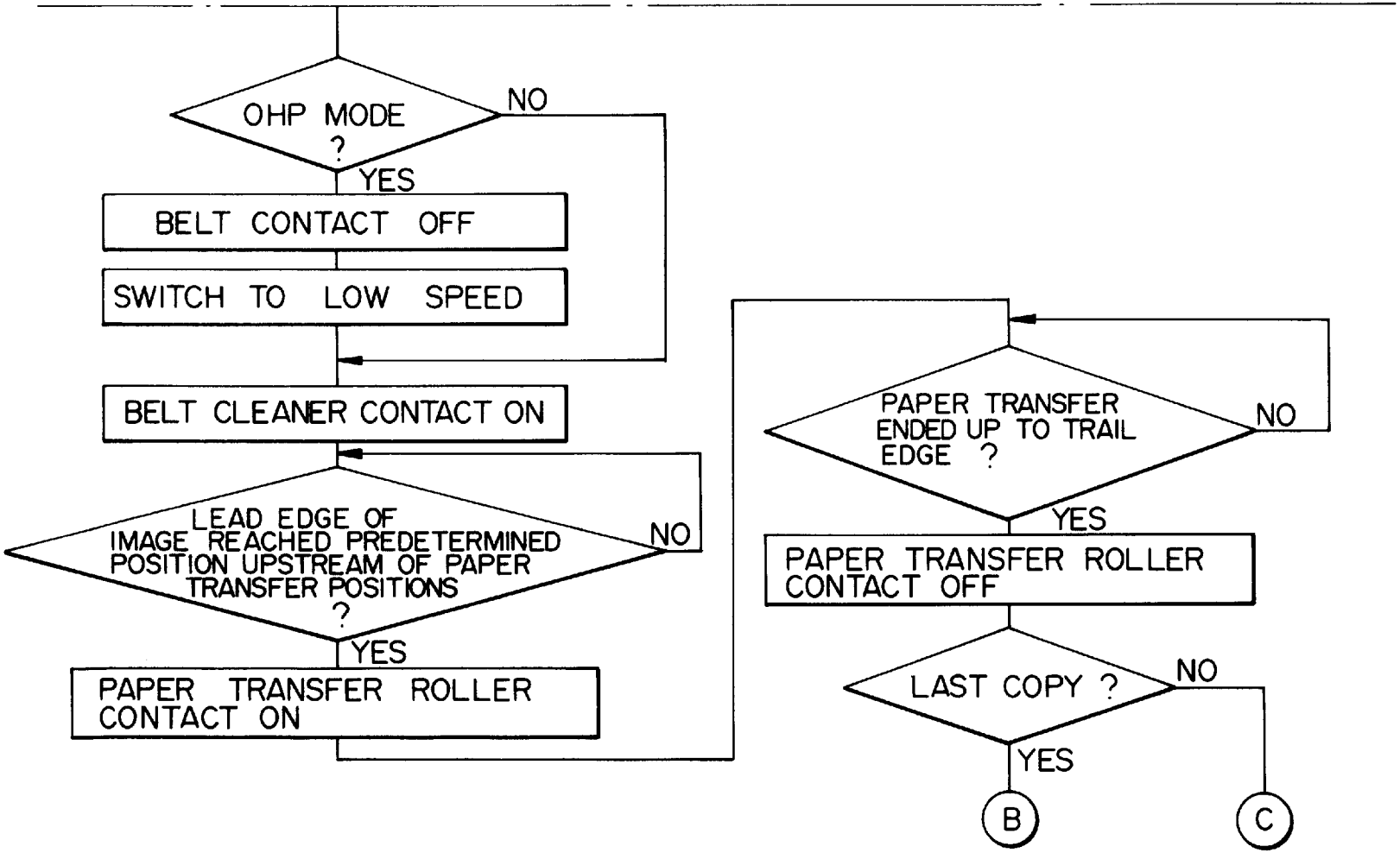
Figures 8, 8A, 8B, 8C:
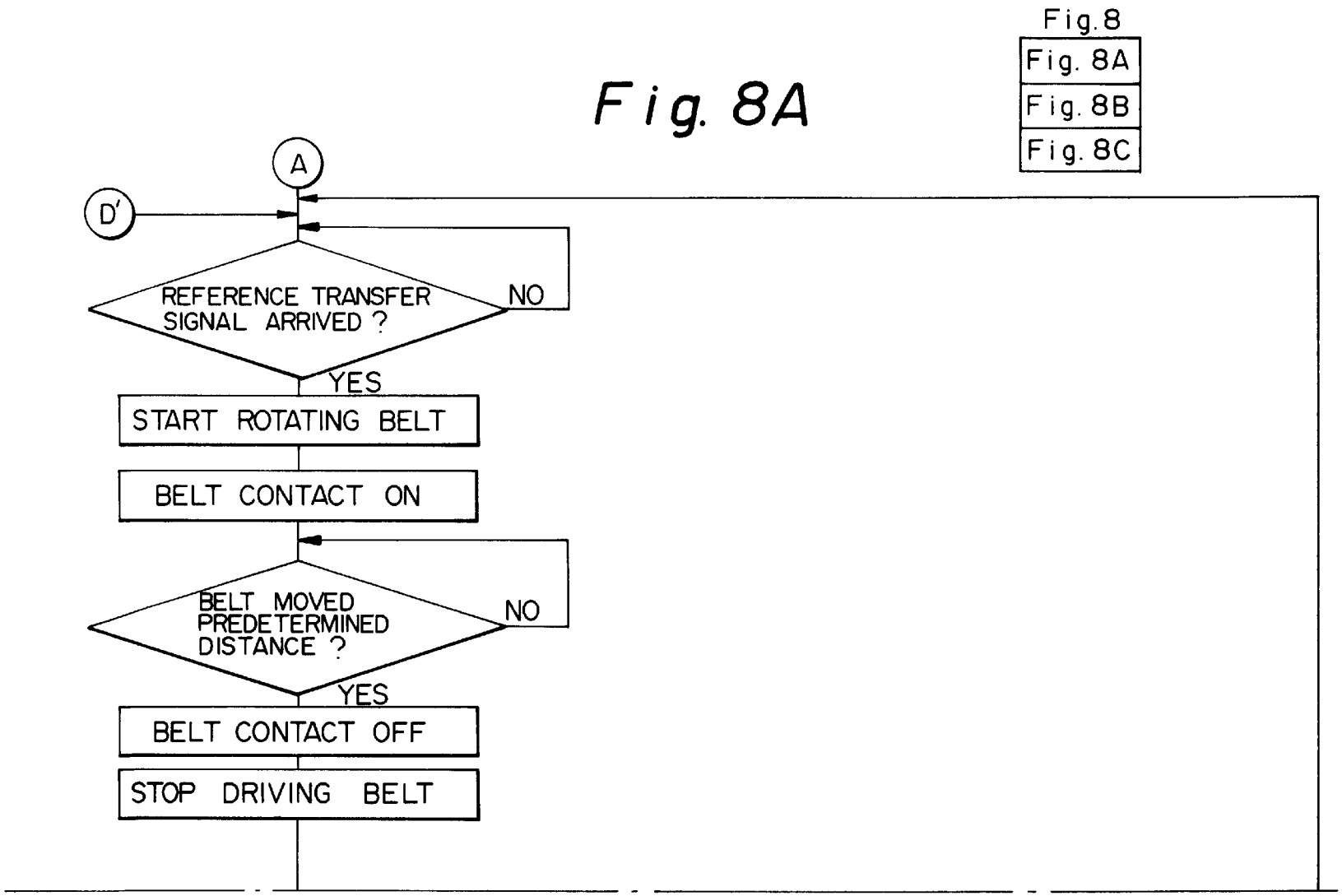
Figure 8B:
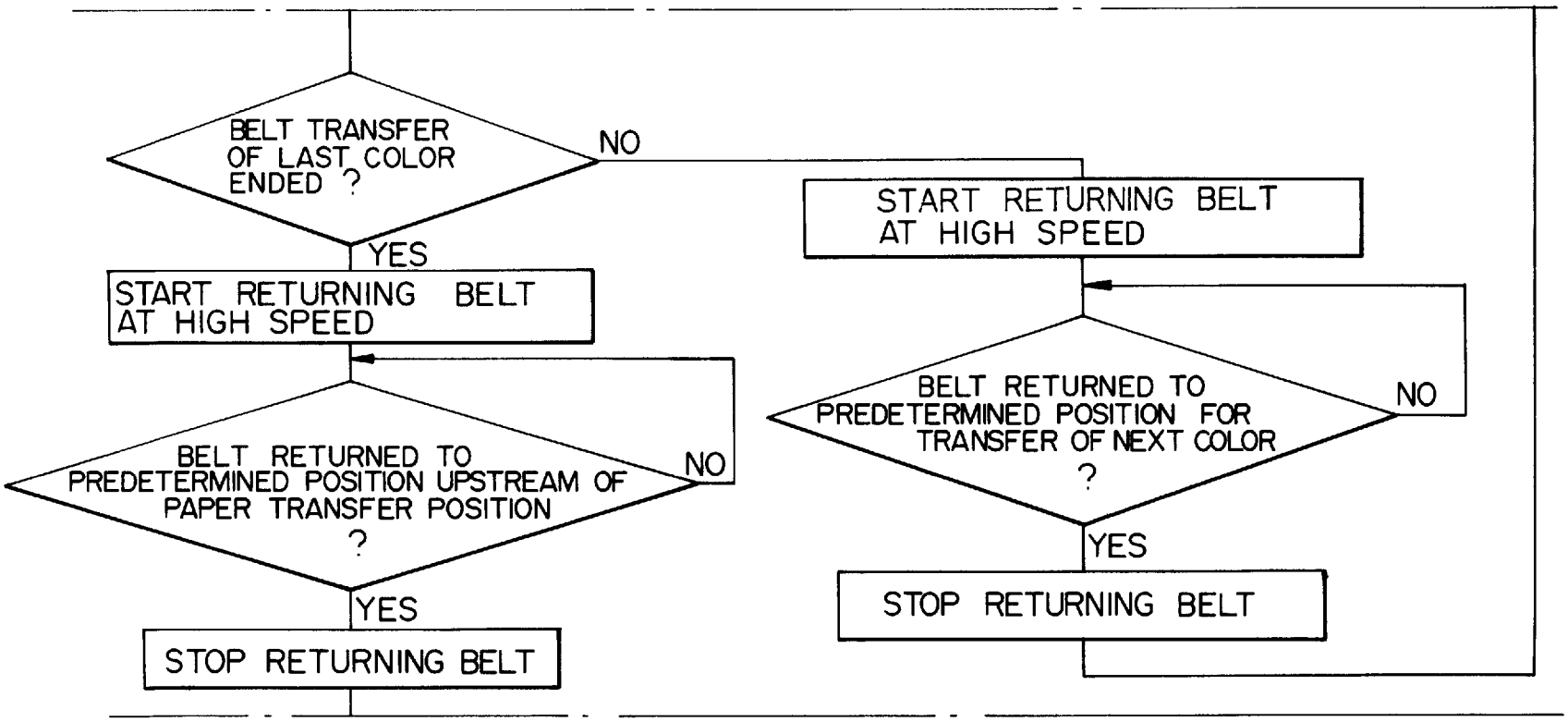
Figure 8C:
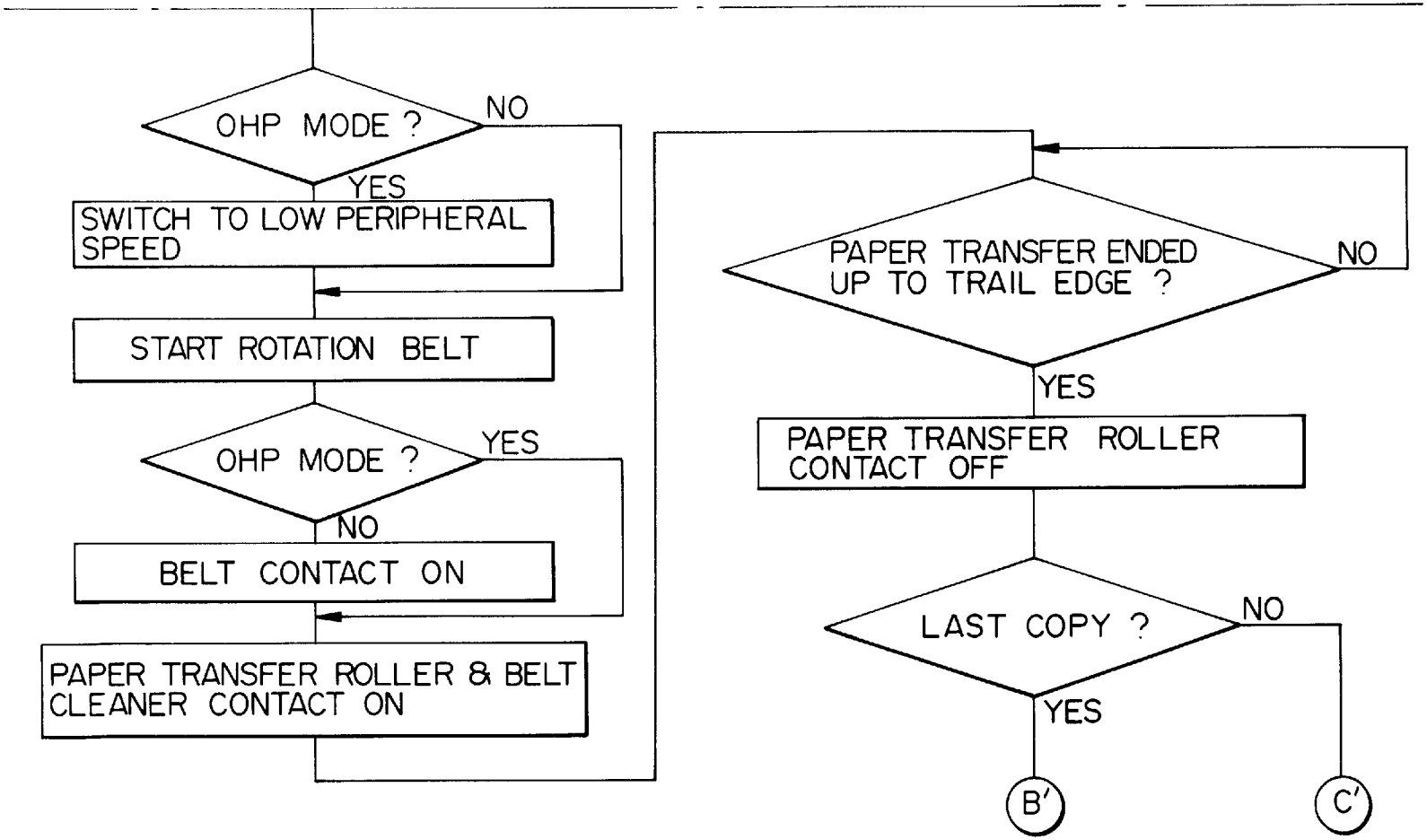
Figure 9:
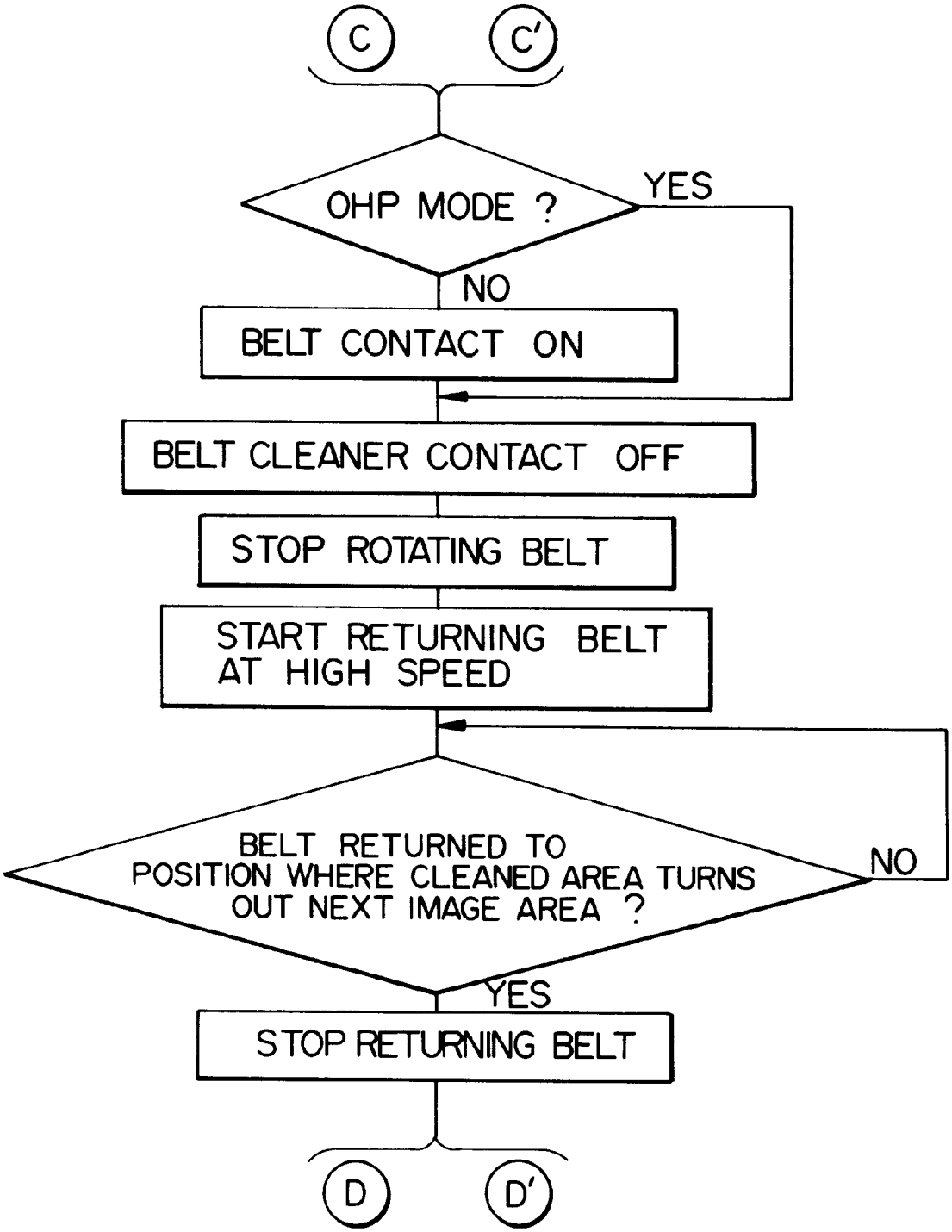
FIGS. 9 and 10 are flowcharts respectively showing the operations of the intermediate transfer belt to occur after cleaning and during cleaning which follows the last copying cycle.
Figure 10:
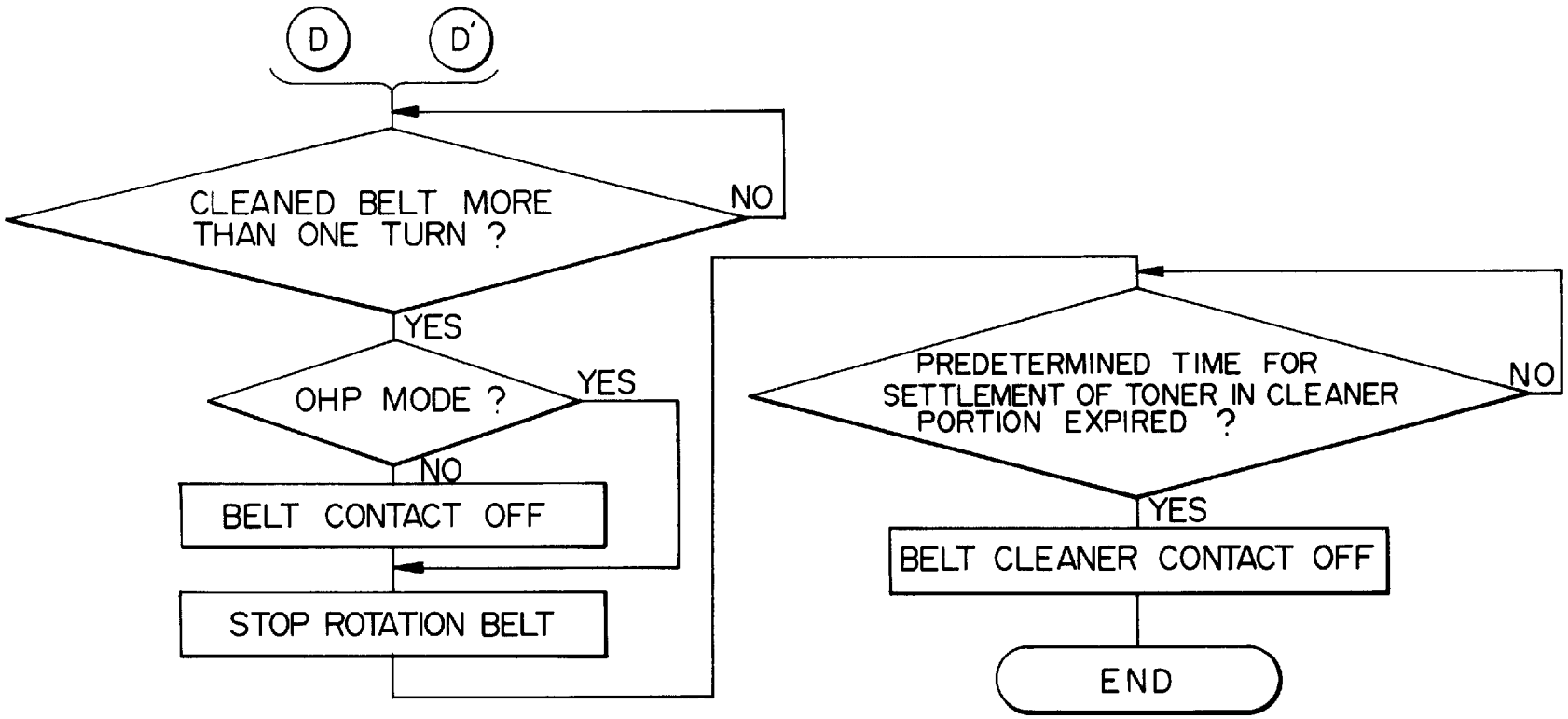

Assume that the OHP mode is selected on the operating section 41, FIG. 4. Then, in the embodiment, the peripheral speed of the belt 19, which has been the same as that of the drum 9, i.e., 180 mm/sec at least during belt transfer, is switched to 90 mm/sec after the belt transfer of a toner image of the last color and before the arrival of the toner image on the belt 19 at the paper transfer position, specifically just after the belt transfer of the toner image of the last color. At this instant, to prevent the belt 19 and drum 9 from rubbing against each other due to a difference in peripheral speed, the former is moved away from the latter by the previously stated mechanism The embodiment executes, in both the plain paper mode and the OHP mode, control for reducing the time loss after the belt transfer of a toner image of the last color, as follows. Assume that an image to be formed has a size (length) $L_p$, and that the belt 19 has a circumferential length $L_T$ as measured from the outlet of a belt transfer region, labeled $L_{BT}$ in FIG. 1, to the inlet of a paper transfer region $L_{PT}$, FIG. 1. After the belt transfer of a toner image of the last color, the embodiment controls the rotation of the belt 19 on the basis of a relation between the dimensions $L_P$ and $L_T$. FIGS. 5 and 7 are respectively a timing chart and a flowchart representative of a procedure wherein a relation $L_P<L_T$ holds. FIGS. 6 and 8 demonstrate a procedure wherein a relation $L_P \geqq L_T$ holds. FIG. 9 is representative of the movement of the belt 19 to occur after belt cleaning in the repeat copy mode. Further, FIG. 10 is indicative of the movement of the belt 19 to occur after belt cleaning which follows the last copying cycle.

When $L_P$ is smaller than $L_T$, the leading edge of an image on the belt 19 has not arrived at the paper transfer position at the end of belt transfer. Hence, the belt 19 is continuously moved forward at the same peripheral speed to cause paper transfer and cleaning to occur (see FIGS. 5 and 7). On the other hand, when $L_P$ is greater than or equal to $L_T$, the leading edge of the image on the belt 19 has arrived at or already moved away from the paper transfer position at the end of belt transfer. Therefore, the belt 19 is once returned before paper transfer such that the leading edge of the image is brought to a position short of the paper transfer position. Subsequently, the belt 19 is again moved forward at a predetermined peripheral speed to cause paper transfer and cleaning to occur. At this instant, the belt 19 is returned at a peripheral speed higher than the forward peripheral speed in order to save time. (see FIGS. 6 and 8).

In the repeat copy mode, when the belt cleaning step ends, there should be eliminated an occurrence that the toner left on the belt 19 in a horizontal stripe due to the cleaning blade 22*b* lies in the next image forming area. For this purpose, even after paper transfer, the cleaning operation is continued such that the cleaning area exceeds the image size $L_P$. As a result, the whole area at least up to the trailing edge of the image is cleaned (see FIG. 9). Further, at the end of the cleaning step following the last copying cycle, the belt 19 is cleaned over one full turn to prevent the toner left on the belt 19 from lying in an image forming area when a copying operation starts again (see FIG. 10).

The OHP mode and the plain paper mode differ from each other in respect of the switchover of the peripheral speed of the belt 19 to occur after the transfer of the last color, and the position of the belt 19 relative to the drum 9 at the time of the switchover of the peripheral speed. Specifically, in the OHP mode, the peripheral speed of the belt 19 is switched to 90 mm/sec, which is the fixing speed in the OHP mode, just after the belt transfer of the last color while, at the same time, the belt 19 is moved away from the drum 9, as indicated by dashed lines in FIGS. 5 and 6. In FIGS. 5 and 6, how the fixing motor and paper transport motor are driven in the OHP mode are also indicated by dashed lines. Further, in the OHP mode, the embodiment switches the peripheral speed of the belt 19 to 90 mm/sec, which is the fixing speed in the OHP mode, just after the belt transfer of the last color, thereby effecting paper transfer at a rate of 90 mm/sec. It follows that the transfer condition and, therefore, the transfer ratio is apt to differ from that of the usual 180 mm/sec paper transfer. To maintain the transfer ratio constant, an arrangement may be made such that when the transfer ratio is greater at 90 mm/sec than at 180 mm/sec, the transfer bias to the paper transfer roller 23*a* is lowered.

Figure 11A:
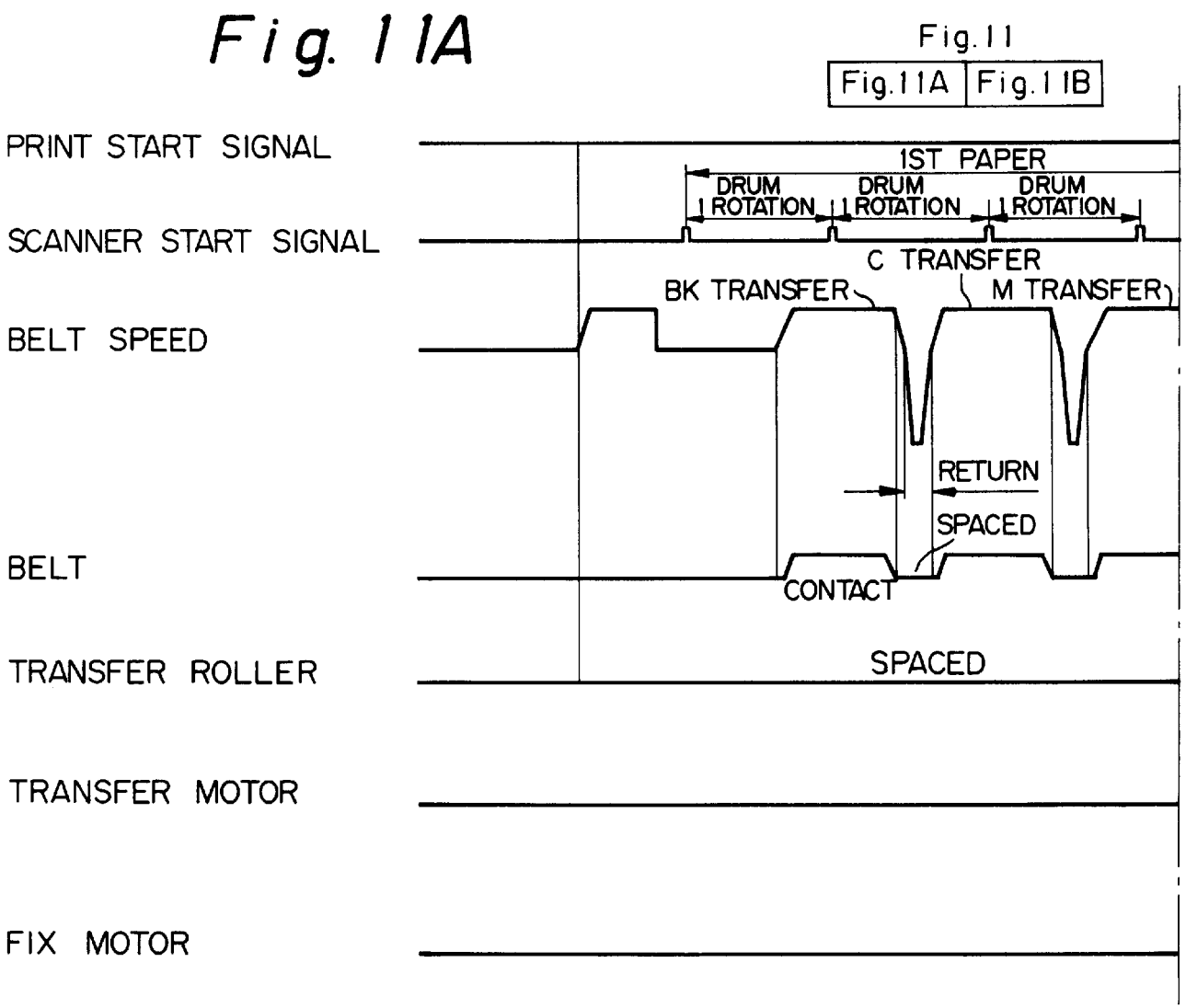
FIGS. 11 and 12 are timing charts respectively demonstrating an alternative procedure in which LP<LT holds and an alternative procedure in which LP≧LT holds.
Figure 11B:
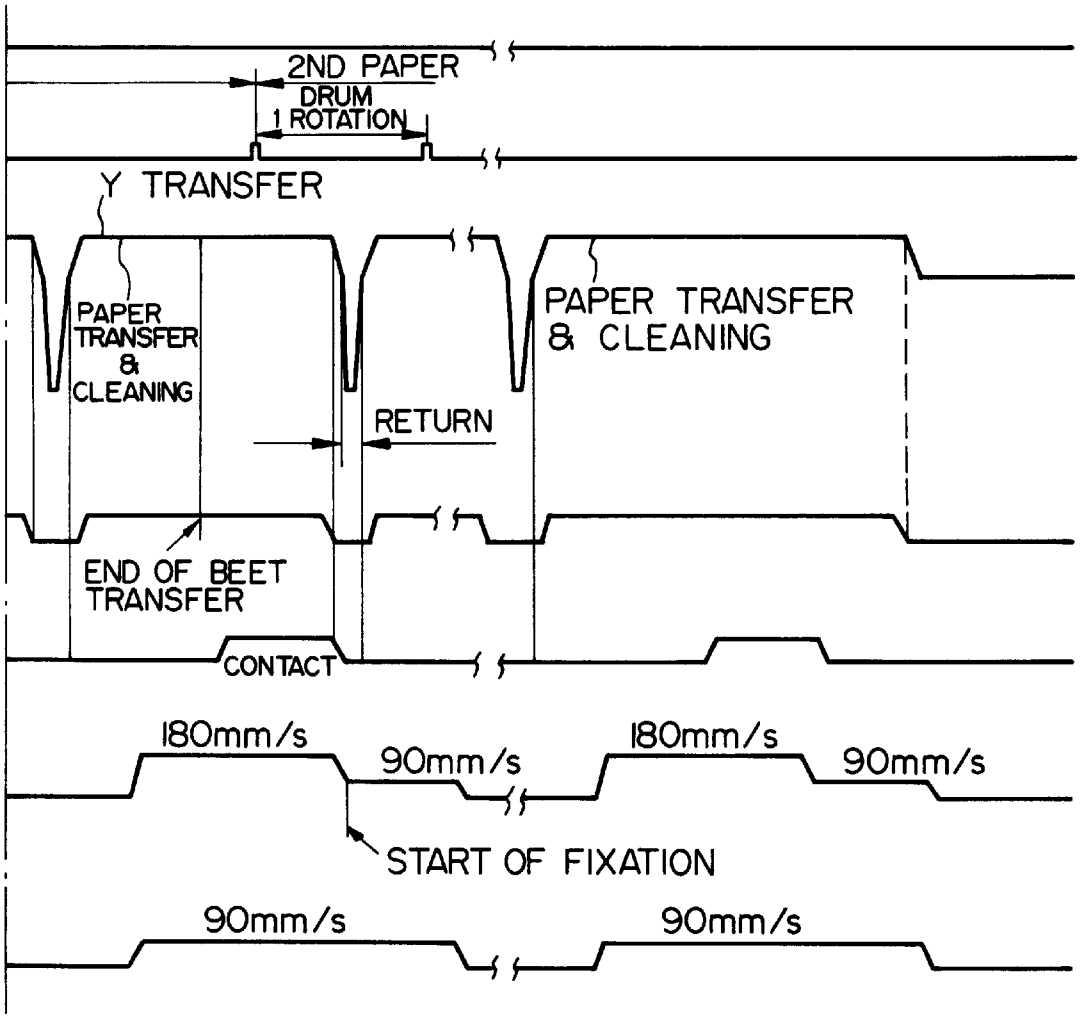

In the control over the belt 19 after the transfer of the last color described above, although the peripheral speed of the belt 19 is switched to 90 mm/sec just after the belt transfer without regard to the length of a paper, such a scheme is only illustrative. When use is made of a paper whose length is smaller than the distance $L_F$ between the outlet of the paper transfer region $L_{PT}$, FIG. 1, and the fixing region $L_{PF}$, FIG. 1, the trailing edge of the paper leaves the paper transfer region before the leading edge enters the fixing region. Hence, as shown in FIG. 11, when the rotation speed of the fixing motor is switched to 90 mm/sec in the OHP mode, the peripheral speed of the belt 19 may be maintained at 180 mm/sec so long as the paper size is small. This alternative scheme allows the belt 19 to move at a relatively high peripheral speed at least up to the end of paper transfer, thereby further preventing the copy speed in the OHP mode from being lowered. At this instant, since the peripheral speed of the belt 19 and that of the drum 9 are the same, the belt 19 may be held in contact with the drum 9. However, the prerequisite is that the motor for the transport unit 27 be so driven as to set up a transport speed of 180 mm/sec during paper transfer and then a transport speed of 90 mm/sec on the entry of the paper into the fixing section. Therefore, by using, for example, a paper size sensor shown in FIG. 4, it is possible to control the belt 19 after the transfer of the last color as shown in FIGS. 6 and 8 or control it as shown in FIG. 11, depending on the relation between the paper size and the distance $L_F$.

Figures 12, 12A:
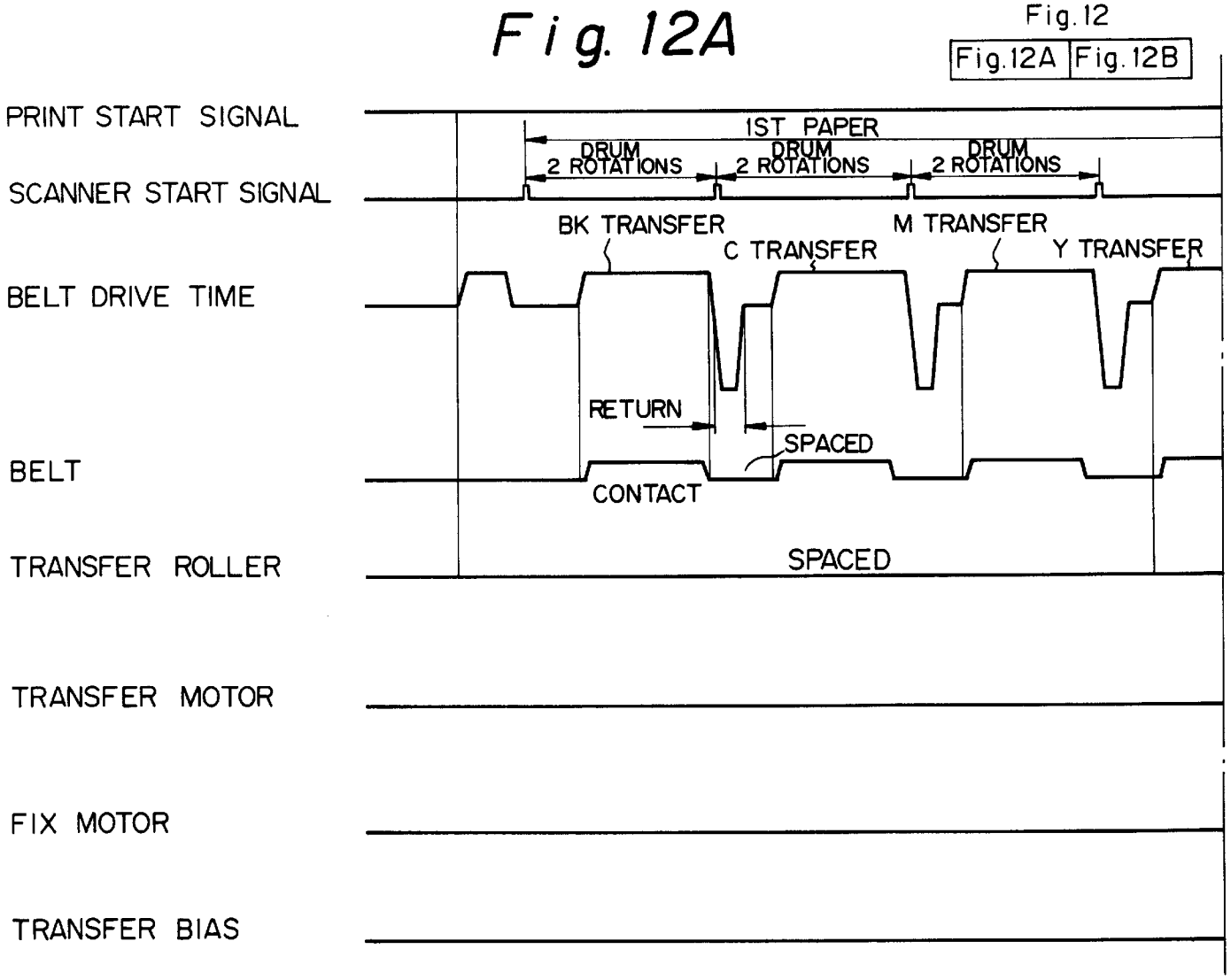
Figure 12B:
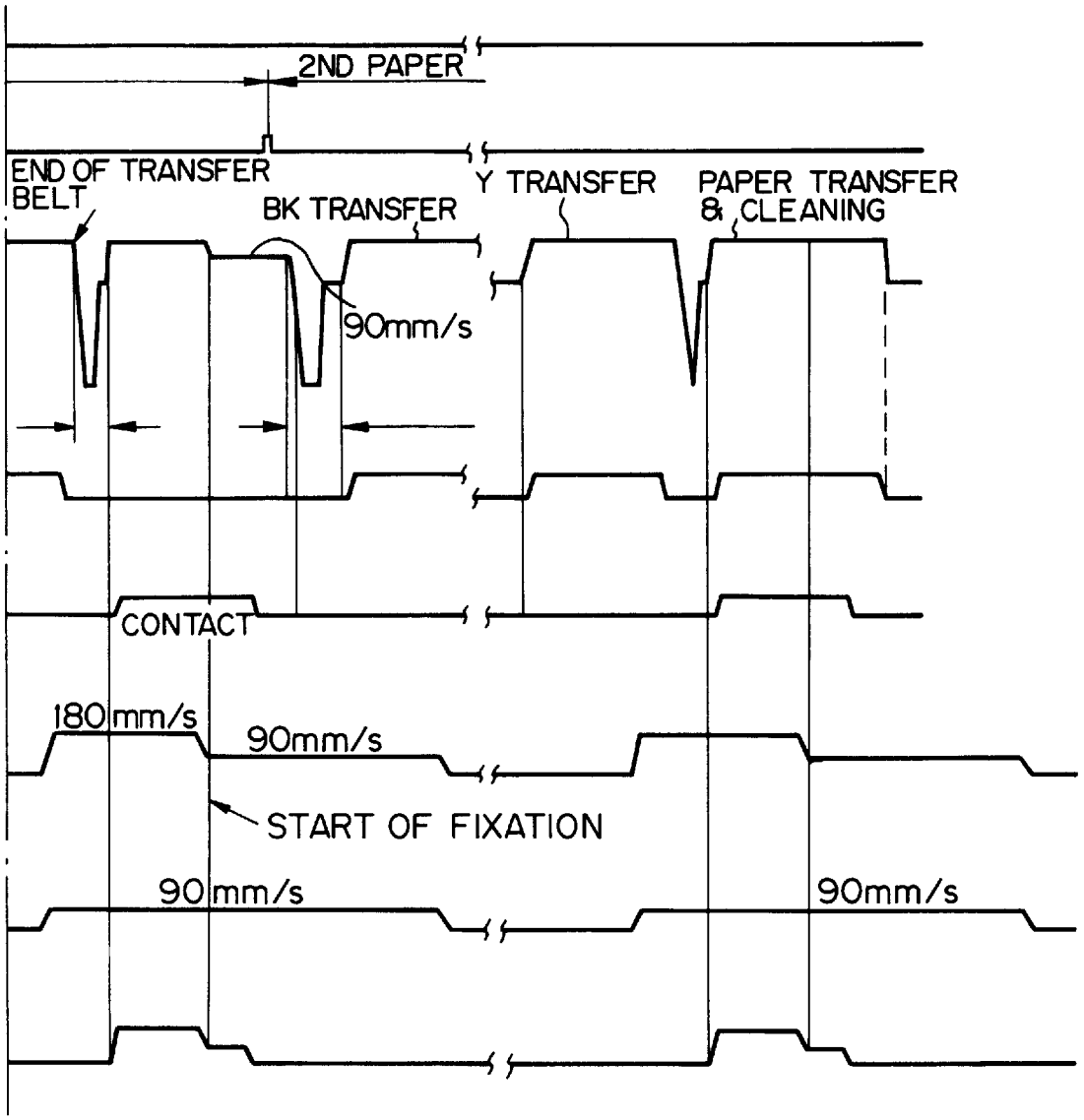

Furthermore, even when the speed of the fixing motor is switched to 90 mm/sec in the OHP mode and the paper has a length greater than the distance $L_F$, it is possible to maintain the peripheral speed of the belt 19 at 180 mm/sec until the leading edge of the paper arrives at the fixing section and then switch it to 90 mm/sec just before the paper enters the fixing section, as shown in FIG. 12. It follows that, by sensing the paper size sensor of FIG. 4, it is possible to control the belt 19 after the transfer of the last color as shown in FIG. 12 or to control it as shown in FIG. 11, depending on the relation between the paper size and the distance $L_F$. However, when the peripheral speed of the belt 19 is switched to 90 mm/sec, it differs from the peripheral speed of the drum 9. In light of this, it is preferable to move the belt 19 away from the drum 9 on the switchover of the peripheral speed to 90 mm/sec, as shown in FIG. 12. Further, it is preferable to switch the motor for the transport unit 27 in synchronism with the switchover of the belt 13. In addition, to maintain the transfer ratio constant, the bias to the paper transfer roller 23*a* should preferably be switched in synchronism with the switchover of the belt 19.

In summary, it will be seen that the present invention provides an image forming apparatus having various unprecedented advantages, as enumerated below.

(1) When fixing speed switching means sets up a low fixing speed, image formation proceeds at the peripheral speed of an image carrier higher than the low fixing speed at least up to the end of image transfer to an intermediate transfer body. This prevents the image forming speed from being lowered. After the image transfer to the intermediate transfer body, the body is driven at a peripheral speed matching the low fixing speed. Hence, when a transfer medium is moved at, for example, a speed matching the low fixing speed in the transfer position of transferring means, there can be obviated misregister due to a difference between the moving speed of the transfer medium and the peripheral speed of the intermediate transfer body. Moreover, assume that the transferring means and fixing means are spaced apart a predetermined distance, and that the transfer medium has a length greater than the predetermined distance and causes the leading edge thereof to reach the fixing section when the trailing end is moving through the transfer section. Then, the medium is prevented from being bent in the predetermined distance due to the leading edge thereof which would otherwise be driven at a higher speed than the leading edge.

(2) The peripheral speed of the intermediate transfer body is switched to one matching the low fixing speed before a toner image on the transfer body enters the electric field of the transferring means. Should the peripheral speed be changed during the transfer of a toner image from the transfer body to a transfer medium, a transfer ratio would change.

(3) When the peripheral speed is switched by peripheral speed switching means, as stated above, the surfaces of the image carrier and intermediate transfer body facing each other are moved away from each other. This prevents the image carrier and transfer body from moving at respective peripheral speeds in contact with each other and damaging each other.

(4) The peripheral speed switching means changes the peripheral speed of the intermediate transfer body, depending on a relation between the distance between the transferring means and the fixing means and the length of a transfer medium. For example, when the length of the transfer medium is sufficiently smaller than the above-mentioned distance, the peripheral speed switching means does not change the peripheral speed of the transfer body; the procedure up to the image transfer to the transfer medium is effected at a peripheral speed matching that of the image carrier. This is successful in preventing the image forming speed from being lowered. When the length of the transfer medium is greater than the distance mentioned above, the switching means changes the peripheral speed of the transfer body in order to prevent the medium from being bent in such a distance.

(5) Even when the transfer medium has a length greater than the distance mentioned above, the intermediate transfer body is driven at a peripheral speed corresponding to that of the image carrier up to the time when the leading edge of the medium is about to reach the fixing means. Hence, the image forming speed is not lowered by more than the decrease in speed in the fixing step.

(6) When the peripheral speed of the intermediate transfer body is switched, the electric field for transfer is also switched by electric field switching means. It follows that the transfer ratio is maintained constant despite a change in the peripheral speed of the transfer body to occur during image transfer to the transfer medium.

Various modifications will become possible for those skilled in the art after receiving the teachings of the present disclosure without departing from the scope thereof.

What is claimed is:

1. An image forming apparatus comprising:

an image carrier for forming a toner image thereon;

an intermediate transfer body to which said toner image is transferred from said image carrier in a first toner image transfer operation;

a transfer medium, a transferring means for transferring said toner image from said intermediate transfer body to said transfer medium in a second toner image transfer operation;

a fixing means for fixing said toner image on said transfer medium;

fixing speed switching means for selectively causing the transfer medium to move through the fixing means at one of a first speed that matches a peripheral speed of the image carrier and a second speed lower than said first speed, said first speed and said second speed corresponding to respective speeds for fixing said toner image on different varieties of said transfer medium; and peripheral speed switching means for switching a peripheral speed of the intermediate transfer body from a peripheral speed matching the peripheral speed of the image carrier necessary for toner image formation during said first toner image transfer operation to a peripheral speed matching said second speed when said fixing speed switching means causes the transfer medium to move through said fixing means as said second speed.

2. An apparatus as claimed in claim 1, wherein said transferring means transfers the toner image from the intermediate transfer body to the transfer medium by forming an electric field.

3. An apparatus as claimed in claim 2, wherein said peripheral speed switching means switches over to the peripheral speed matching said second speed before the toner image on the intermediate transfer body enters said electric field formed by said transferring means.

4. An apparatus as claimed in claim 1, wherein said transferring means transfers the toner image from the image carrier to the intermediate transfer body by maintaining a surface of said image carrier and a surface of the intermediate transfer body which face each other in contact.

5. An apparatus as claimed in claim 4, further comprising spacing means for spacing the surface of said image carrier and the surface of the intermediate transfer body apart from each other when said peripheral speed switching means switches the peripheral speed.

6. An apparatus as claimed in claim 1, wherein said transferring means and said fixing means are spaced a predetermined distance from each other.

7. An apparatus as claimed in claim 6, further comprising control means for determining whether said peripheral speed switching means should switch the peripheral speed or not, depending on a relation between said predetermined distance and a length of the transfer medium.

8. An apparatus as claimed in claim 7, wherein when the transfer medium has a length greater than said predetermined distance, said control means causes said peripheral speed switching means to switch the peripheral speed of the intermediate transfer body after a leading edge of said transfer medium has moved away from the transferring means and before said leading edge reaches the fixing means.

9. An apparatus as claimed in claim 8, wherein the transferring means transfers the toner image from the intermediate transfer body to the transfer medium by forming an electric field.

10. An apparatus as claimed in claim 9, further comprising electric field switching means for switching said electric field before said peripheral speed switching means switches the peripheral speed of the intermediate transfer body, said peripheral speed of the intermediate transfer body and said electric field forming a constant transfer ratio such that the constant transfer ratio remains constant before and after the peripheral speed of the intermediate transfer body is switched.

* * * * *